US011226164B2

(12) United States Patent
Higashiiue et al.

(10) Patent No.: US 11,226,164 B2
(45) Date of Patent: Jan. 18, 2022

(54) STACKED HEADER, HEAT EXCHANGER, AND AIR-CONDITIONING APPARATUS

(71) Applicant: Mitsubishi Electric Corporation, Tokyo (JP)

(72) Inventors: Shinya Higashiiue, Tokyo (JP); Shigeyoshi Matsui, Tokyo (JP); Takehiro Hayashi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 167 days.

(21) Appl. No.: 16/086,374

(22) PCT Filed: May 23, 2016

(86) PCT No.: PCT/JP2016/065180

§ 371 (c)(1),
(2) Date: Sep. 19, 2018

(87) PCT Pub. No.: WO2017/203566

PCT Pub. Date: Nov. 30, 2017

(65) Prior Publication Data

US 2019/0093965 A1 Mar. 28, 2019

(51) Int. Cl.
*F28F 9/02* (2006.01)
*F28D 1/053* (2006.01)
(Continued)

(52) U.S. Cl.
CPC ..... *F28F 9/0278* (2013.01); *F25B 39/028* (2013.01); *F28D 1/0435* (2013.01);
(Continued)

(58) Field of Classification Search
CPC ..... F25B 13/00; F25B 39/028; F25B 39/04; F28D 1/0435; F28D 1/0476;
(Continued)

(56) References Cited

U.S. PATENT DOCUMENTS 4,829,780 A * 5/1989 Hughes ..... F28F 13/04 62/288
5,241,839 A 9/1993 Hughes
(Continued)

FOREIGN PATENT DOCUMENTS

CN 202902982 U 4/2013
CN 105378421 A 3/2016
(Continued)

OTHER PUBLICATIONS

Laura Firszt, 10 Popular Roofing Styles: Which is the Best for You?, Sep. 17, 2014, networx.com, https://www.networx.com/article/10-popular-roofing-styles-which-is-the (Year: 2014).*
(Continued)

*Primary Examiner* — Larry L Furdge
*Assistant Examiner* — Chang H Park
(74) *Attorney, Agent, or Firm* — Posz Law Group, PLC

(57) ABSTRACT

A stacked header branches one flow path into a plurality of flow paths. The stacked header includes an upper end part positioned at an upper end of the stacked header in a gravity direction, a lower end part positioned at a lower end of the stacked header in the gravity direction, and a flow path forming part positioned between the upper end part and the lower end part and having a flow path formed in the flow path forming part. At least one of the upper end part or the lower end part is a non-horizontal face part having a non-horizontal face slanted with respect to a horizontal plane.

11 Claims, 13 Drawing Sheets

(51) Int. Cl.

| | |
|---|---|
| ***F28D 1/047*** | (2006.01) |
| ***F25B 39/02*** | (2006.01) |
| ***F28F 9/26*** | (2006.01) |
| ***F28D 1/04*** | (2006.01) |
| ***F28D 21/00*** | (2006.01) |
| ***F28F 1/32*** | (2006.01) |
| ***F25B 39/04*** | (2006.01) |
| ***F25B 13/00*** | (2006.01) |

(52) U.S. Cl.
CPC ..... *F28D 1/0476* (2013.01); *F28D 1/05391* (2013.01); *F28F 9/0221* (2013.01); *F28F 9/262* (2013.01); *F25B 13/00* (2013.01); *F25B 39/04* (2013.01); *F28D 2021/0068* (2013.01); *F28F 1/32* (2013.01)

(58) Field of Classification Search
CPC F28D 1/05391; F28D 2021/0068; F28F 1/32; F28F 9/0221; F28F 9/0278; F28F 9/262
USPC ..... 165/173
See application file for complete search history.

(56) References Cited

U.S. PATENT DOCUMENTS

| | | | | |
|---|---|---|---|---|
| 7,036,567 | B2 * | 5/2006 | Shimanuki | F24F 13/222 165/110 |
| 10,054,376 | B2 * | 8/2018 | Higashiiue | F28F 9/026 |
| 2014/0290296 | A1 * | 10/2014 | Katoh | B60H 1/3227 62/238.7 |
| 2016/0195335 | A1 | 7/2016 | Nishiyama et al. | |
| 2016/0245596 | A1 | 8/2016 | Higashiiue et al. | |

FOREIGN PATENT DOCUMENTS

| | | | |
|---|---|---|---|
| FR | 2037366 | A5 | 12/1970 |
| JP | S58-071651 | U | 5/1983 |
| JP | H03-036497 | A | 2/1991 |
| JP | H03-046759 | U | 4/1994 |
| JP | H06-137779 | A | 5/1994 |
| JP | 2001-066088 | A | 3/2001 |
| WO | 2015/063857 | A1 | 5/2015 |

OTHER PUBLICATIONS

Office Action dated Mar. 9, 2020 issued in corresponding CN patent application No. 201680085744.5 (and English translation).
Office Action dated Mar. 18, 2020 issued in corresponding European patent application No. 16903048.3.
International Search Report of the International Searching Authority dated Aug. 9, 2016 for the corresponding international application No. PCT/JP2016/065180 (and English translation).
Extended European Search Report dated May 3, 2019 issued in corresponding EP patent application No. 16903048.3.
Examination Report dated May 14, 2019 issued in corresponding AU patent application No. 2016408458.
Office Action dated Nov. 24, 2020 issued in corresponding CN patent application No. 201680085744.5 (and English machine translation).

* cited by examiner

Related Art

Related Art

STACKED HEADER, HEAT EXCHANGER, AND AIR-CONDITIONING APPARATUS

CROSS REFERENCE TO RELATED APPLICATION

This application is a U.S. national stage application of PCT/JP2016/065180 filed on May 23, 2016, the contents of which are incorporated herein by reference.

TECHNICAL FIELD

The present invention relates to a distributor used in a thermal circuit or other devices, a stacked header, a heat exchanger, and an air-conditioning apparatus.

BACKGROUND ART

A heat exchanger includes flow paths (paths) formed by arranging a plurality of heat transfer tubes parallel to one another, for the purpose of alleviating pressure loss of refrigerant flowing through the heat transfer tubes. At refrigerant inlet parts of the heat transfer tubes, a distributor such as a header and a distributing device, for example, configured to evenly distribute the refrigerant to the heat transfer tubes is provided.

To ensure excellent heat transfer performance of the heat exchanger, it is important to evenly distribute the refrigerant to the plurality of heat transfer tubes.

As an example of such a distributor, for example, a distributor has been proposed in which distributing flow paths branching from one inlet flow path into a plurality of outlet flow paths are formed by stacking a plurality of plates together, so that refrigerant can be distributed and supplied to each of the heat transfer tubes of a heat exchanger (see Patent Literature 1, for example).

In a distributor such as one disclosed in Patent Literature 1, an upper end part and a lower end part of the distributor are each a flat face. In the following explanations, the upper end part shaped as a flat face will be referred to as an upper end flat face part, whereas the lower end part shaped as a flat face will be referred to as a lower end flat face part.

CITATION LIST

Patent Literature

Patent Literature 1: international Publication No. WO 2015/063857

SUMMARY OF INVENTION

Technical Problem

While a heat exchanger is being used as an evaporator, moisture in the air adheres to the distributor as condensed water. The condensed water generated on the upper end part of the distributor stagnates at the upper end flat face part of the distributor. When the distributor is manufactured by using a material containing aluminum, the condensed water stagnating at the upper end flat face part of the distributor can be a cause of corrosion of the distributor. Such corrosion of the distributor leads to degradation of reliability of the heat exchanger.

Further, some of the condensed water having flowed downward along the distributor due to the gravity may reach the lower end flat face part of the distributor. In addition, when two or more distributors are installed and arranged in the direction of the gravity, some condensed water may stagnate between the distributors. While the heat exchanger is being used as an evaporator under the condition where the temperature of the outdoor air is low, for example, as low as 2 degrees C., the generated condensed water becomes ice. Because the specific volume of ice is larger than that of water, when the ice grows upward in the gravity direction, the distributor positioned immediately above will be pushed upward. When being pushed up in this manner, the distributor may be deformed. As a result, the heat exchanger may be damaged, and the reliability of the heat exchanger may be degraded.

In view of the problems described above in the background, it is an object of the present invention to provide a distributor, a stacked header, a heat exchanger, and an air-conditioning apparatus that prevent the generated condensed water from stagnating.

Solution to Problem

A distributor according to one embodiment of the present invention is a distributor branching one flow path into a plurality of flow paths, including an upper end part positioned at an upper end of the distributor in a gravity direction, a lower end part positioned at a lower end of the distributor in the gravity direction, and a flow path forming part positioned between the upper end part and the lower end part and having a flow path formed in the flow path forming part. At least one of the upper end part and the lower end part is a non-horizontal face part having a non-horizontal face slanted to a horizontal plane.

A stacked header according to another embodiment of the present invention forms the abovementioned distributor that includes a plurality of plates stacked together.

A heat exchanger according to yet another embodiment of the present invention includes the abovementioned distributor and a plurality of heat transfer tubes connected to the distributor.

An air-conditioning apparatus according to yet another embodiment of the present invention includes the abovementioned heat exchanger.

Advantageous Effects of Invention

In a distributor according to one embodiment of the present invention, at least one of the upper end part and the lower end part is the non-horizontal face part having the non-horizontal face slanted to a horizontal plane. Consequently, water easily falls down, and it is thus possible to prevent the water from stagnating.

A stacked header according to another embodiment of the present invention forms the abovementioned distributor that includes the plurality of plates stacked together. Consequently, the same advantageous effects as those of the abovementioned distributor can be obtained.

A heat exchanger according to yet another embodiment of the present invention includes the abovementioned distributor. Consequently, the heat exchanger is able to prevent water from stagnating and therefore has high reliability.

An air-conditioning apparatus according to yet another embodiment of the present invention includes the abovementioned heat exchanger. Consequently, the air-conditioning apparatus has enhanced reliability, in particular, during heating operations.

DESCRIPTION OF EMBODIMENTS

Figure 1:
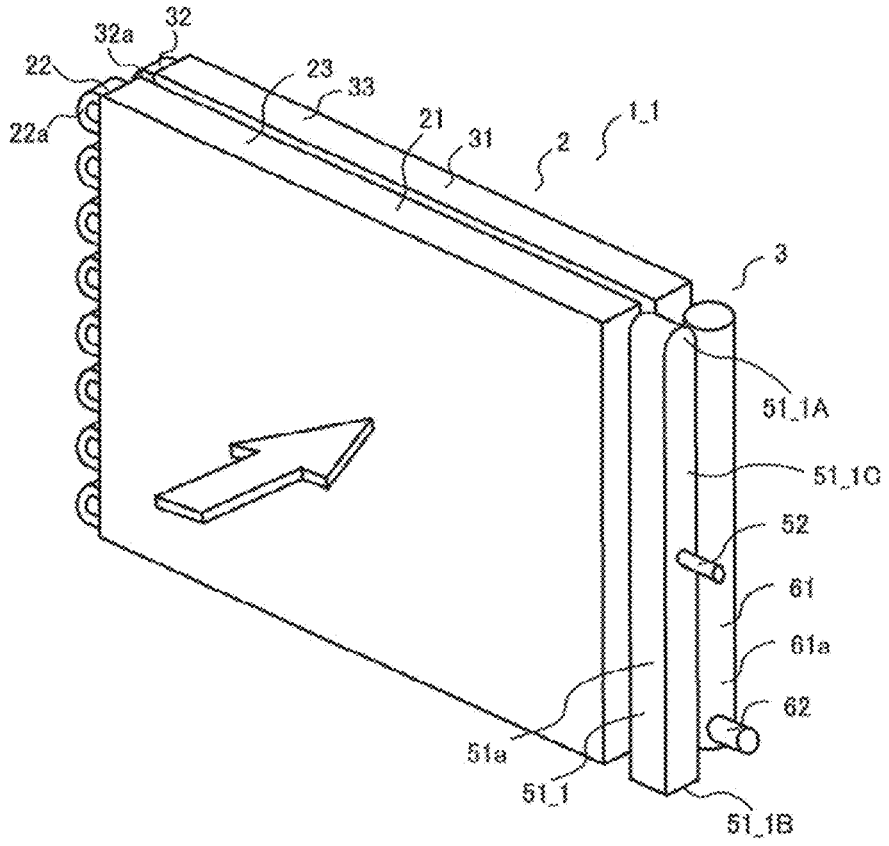
FIG. 1 is a perspective view of a heat exchanger according to Embodiment 1.

A distributor, a stacked header, a heat exchanger, and an air-conditioning apparatus according to the present invention will be explained below, with reference to the drawings.

The configurations, operations, and other features explained below are merely examples. Possible embodiments of the distributor, the stacked header, the heat exchanger, and the air-conditioning apparatus according to the present invention are not limited to such configurations, operations, and features explained below. Further, in the drawings, some of the elements that are the same as or similar to one another are referred to by using the same reference signs, or the use of reference signs for such elements is omitted. Further, the illustration of detailed structures in the drawings is either simplified or omitted, as appropriate. Further, duplicate or similar explanations will be either simplified or omitted, as appropriate.

In the following sections, examples will be explained in which the distributor, the stacked header, and the heat exchanger according to the present invention are used in an air-conditioning apparatus; however, possible embodiments are not limited to those of the examples. For example, the distributor, the stacked header, and the heat exchanger according to the present invention may be used in other refrigeration cycle apparatuses each including a refrigerant cycle circuit. Further, although the following describes examples in which the distributor, the stacked header, and the heat exchanger according to the present invention are used in an outdoor heat exchanger of an air-conditioning apparatus, possible embodiments are not limited to those of the examples. The distributor, the stacked header, and the heat exchanger according to the present invention may be used in an indoor heat exchanger of an air-conditioning apparatus. Further, although the following describes the examples in which the air-conditioning apparatus switches between a heating operation and a cooling operation, possible embodiments are not limited to those of the examples. The air-conditioning apparatus may be configured to perform only a heating operation or only a cooling operation.

Embodiment 1

A distributor, a stacked header, a heat exchanger, and an air-conditioning apparatus according to Embodiment 1 will be explained.

<Configuration of Heat Exchanger 1_1>

The following will describe a schematic configuration of a heat exchanger 1_1 according to Embodiment 1.

FIG. 1 is a perspective view of a heat exchanger 1_1 according to Embodiment 1.

As illustrated in FIG. 1, the heat exchanger 1_1 includes a heat exchanging part 2 and a distributing and combining part 3.

<Heat Exchanging Part 2>

The heat exchanging part 2 includes a windward heat exchanging part 21 provided windward, and a leeward heat exchanging part 31 provided leeward in the passage direction (indicated with the outlined arrow in the drawing) of the air passing through the heat exchanging part 2. The windward heat exchanging part 21 includes a plurality of windward heat transfer tubes 22 and a plurality of windward fins 23 joined with the plurality of windward heat transfer tubes 22 by, for example, performing a brazing process or other processes. The leeward heat exchanging part 31 includes a plurality of leeward heat transfer tubes 32 and a plurality of leeward fins 33 joined with the plurality of leeward heat transfer tubes 32 by, for example, performing a brazing process or other processes.

FIG. 1 illustrates the example in which the heat exchanging part 2 is structured with the two rows made up of the windward heat exchanging part 21 and the leeward heat exchanging part 31; however, the heat exchanging part 2 may be structured with three or more rows. In this case, the heat exchanging part 2 may additionally have a heat exchanging part having the same configuration as that of either the windward heat exchanging part 21 or the leeward heat exchanging part 31.

The windward heat transfer tubes 22 and the leeward heat transfer tubes 32 are each a flat tube, for example, having a plurality of flow paths formed in the flat tube. Each of the plurality of windward heat transfer tubes 22 and the plurality of leeward heat transfer tubes 32 has a corresponding one of a folded part 22*a* and a folded part 32*a*, as a result of a section positioned between one end and the other end of each of the plurality of windward heat transfer tubes 22 and the plurality of leeward heat transfer tubes 32 that is folded in the manner of a hair pin. The windward heat transfer tubes 22 and the leeward heat transfer tubes 32 are arranged on a plurality of levels along the direction intersecting the passage direction (indicated with the outlined arrow in the drawing) of the air passing through the heat exchanging part 2. The one end and the other end of each of the plurality of windward heat transfer tubes 22 and the plurality of leeward heat transfer tubes 32 face the distributing and combining part 3.

Each of the windward heat transfer tubes 22 and the leeward heat transfer tubes 32 is not limited to a flat tube and may be a round tube, for example, having a diameter of 4 mm. Further, although the example is explained in which each of the windward heat transfer tubes 22 and the leeward heat transfer tubes 32 is folded in a U-shape to form a corresponding one of the folded part 22*a* and a folded part 32*a*, another arrangement is also acceptable in which the folded parts 22*a* and the folded parts 32*a* are each a separate part of an U-shaped tubes and the flow paths are folded back by connecting the U-shaped tubes each of which has a flow path formed in the U-shaped tube.

<Distributing and Combining Part 3>

The distributing and combining part 3 includes a stacked header 51_1 and a cylindrical header 61, The stacked header 51_1 and the cylindrical header 61 are arranged next to each another along the passage direction (indicated with the outlined arrow in the drawing) of the air passing through the heat exchanging part 2, To the stacked header 51_1, a refrigerant pipe (not illustrated) is connected via a connection pipe 52. To the cylindrical header 61, a refrigerant pipe (not illustrated) is connected via a connection pipe 62. The connection pipe 52 and the connection pipe 62 each may be a round pipe, for example.

On the inside of the stacked header 51_1 serving as a distributor, a distributing and combining flow path 51*a* connected to the windward heat exchanging part 21 is formed. While the heat exchanging part 2 is operating as an evaporator, the distributing and combining flow path 51*a* serves as a distributing flow path that causes the refrigerant flowing in through the refrigerant pipe (not illustrated) to flow out to be distributed to the plurality of windward heat transfer tubes 22 included in the windward heat exchanging part 21. Further, while the heat exchanging part 2 is operating as a condenser (a radiator), the distributing and combining flow path 51*a* serves as a combining flow path that causes the refrigerant flowing in through the plurality of windward heat transfer tubes 22 included in the windward heat exchanging part 21 to be combined together to flow out to the refrigerant pipe (not illustrated).

On the inside of the cylindrical header 61, a distributing and combining flow path 61*a* connected to the leeward heat exchanging part 31 is formed. While the heat exchanging part 2 is operating as a condenser (a radiator), the distributing and combining flow path 61*a* serves as a distributing flow path that causes the refrigerant flowing in through the refrigerant pipe (not illustrated) to flow out to be distributed to the plurality of leeward heat transfer tubes 32 included in the leeward heat exchanging part 31. Further, while the heat exchanging part 2 is operating as an evaporator, the distributing and combining flow path 61*a* serves as a combining flow path that causes the refrigerant flowing in through the plurality of leeward heat transfer tubes 32 included in the leeward heat exchanging part 31 to be combined together to flow out to the refrigerant pipe (not illustrated).

In other words, while the heat exchanging part 2 is operating as an evaporator, the heat exchanger 1_1 has, separately from each other, the stacked header 51_1 having the distributing flow path (the distributing and combining flow path 51*a*) formed in the stacked header 51_1 and the cylindrical header 61 having the combining flow path (the distributing and combining flow path 61*a*) formed in the cylindrical header 61.

In contrast, while the heat exchanging part 2 is operating as a condenser, the heat exchanger 1_1 has, separately from each other, the cylindrical header 61 having the distributing flow path (the distributing and combining flow path 61*a*) formed in the cylindrical header 61 and the stacked header 51_1 having the combining flow path (the distributing and combining flow path 51*a*) formed in the stacked header 51_1, <Configuration of Stacked Header 51_1>

Next, a configuration of the stacked header 51_1 included in the heat exchanger 1_1 according to Embodiment 1 will be explained.

Figure 2:
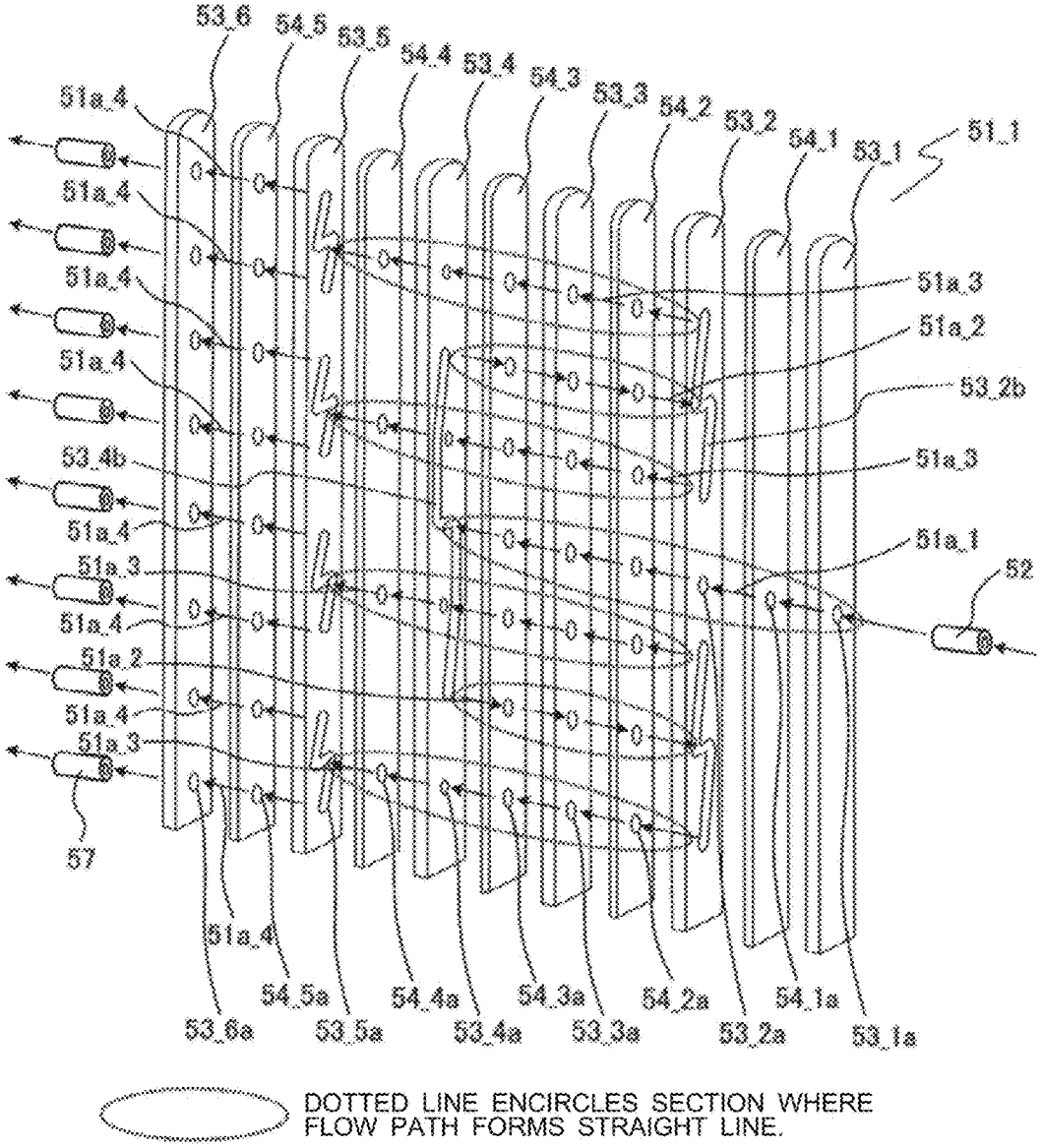
FIG. 2 is a perspective view in an exploded state of a stacked header included in the heat exchanger according to Embodiment 1.
Figure 3:
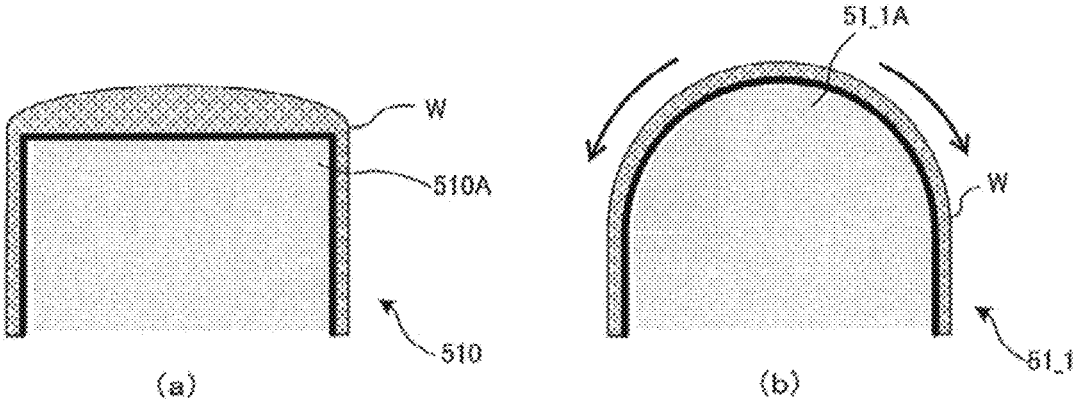
FIG. 3 is an explanatory drawing for explaining a water flow in the stacked header included in the heat exchanger according to Embodiment 1 in comparison to that in a conventional example.

FIG. 2 is a perspective view in an exploded state of the stacked header 51_1 included in the heat exchanger 1_1 according to Embodiment 1. FIG. 3 is an explanatory drawing for explaining a water flow in the stacked header 51_1 included in the heat exchanger 1_1 according to Embodiment 1 in comparison to that in a conventional example. FIG. 4 to FIG. 8 are schematic drawings of examples of shapes of an upper end part 51_1A of the stacked header 51_1 included in the heat exchanger 1_1 according to Embodiment 1.

In FIG. 2, the arrows indicate flows of the refrigerant observed while the distributing and combining flow path 51*a* of the stacked header 51_1 is serving as a distributing flow path.

Further, FIG. 3(*a*) illustrates an upper end part 510A of a conventional stacked header 510, whereas FIG. 3(*b*) illustrates the upper end part 51_1A of the stacked header 51_1.

As illustrated in FIG. 2, the stacked header 51_1 is formed by stacking together a plurality of first plates 53_1 to 53_6 and a plurality of second plates 54_1 to 54_5 alternately interposed between the first plates 53_1 to 53_6.

Further, the stacked header 51_1 is attached to the heat exchanging part 2 in such a manner that the longitudinal direction of the stacked header 51_1 extends parallel to the gravity direction.

In the stacked header 51_1, the upper end part 51_1A is formed at an upper end of the stacked header 51_1 in the gravity direction, while a lower end part 51_1B is formed at a lower end of the stacked header 51_1 in the gravity direction. A flow path forming part 51_10 is formed between the upper end part 51_1A and the lower end part 51_1B.

The flow path forming part 51_1C has partial flow paths and distributing and combining flow paths that are formed in the flow path forming part 51_1C and explained below.

The plurality of first plates 53_1 to 53_6 have partial flow paths 53_1*a* to 53_6*a* formed in the plurality of first plates 53_1 to 53_6, respectively.

The first plate 53_1 has one partial flow path 53_1*a* formed in the first plate 53_1.

In addition to one partial flow path 53_2*a*, the first plate 53_2 has two partial flow paths 53_2*b* formed in the first plate 53_2.

The first plate 53_3 has seven partial flow paths 53_3*a* formed in first plate 53_3.

In addition to four partial flow paths 53_4*a*, the first plate 53_4 has a partial flow path 53_4*b* formed in the first plate 53_4.

The first plate 53_5 has four partial flow paths 53_5*a* formed in the first plate 53_5.

The first plate 53_6 has eight partial flow paths 53_6*a* formed in the first plate 53_6.

The plurality of second plates 54_1 to 54_5 have partial flow paths 54_1*a* to 54_5*a* formed in the plurality of second plates 54_1 to 54_5, respectively.

The second plate 54_1 has one partial flow path 54_1*a* formed in the second plate 54_1.

The second plate 54_2 has seven partial flow paths 54_2*a* formed in the second plate 54_2.

The second plate 54_3 has seven partial flow paths 54_3*a* formed in the second plate 54_3.

The second plate 54_4 has four partial flow paths 54_4*a* formed in the second plate 54_4.

The second plate 54_5 has eight partial flow paths 54_5*a* formed in the second plate 54_5.

One or both sides of each of the second plates 54_1 to 54_5 are cladded (coated) with a brazing material.

In other words, the first plates 53_1 to 53_6 are stacked together with the second plates 54_1 to 54_5 alternately interposed between the first plates 53_1 to 53_6 and are integrally joined together by a brazing process.

In the following explanations, the plurality of first plates 53_1 to 53_6 and the plurality of second plates 54_1 to 54_5 may collectively be referred to as "plates".

Although the wall thicknesses of the plates and the material used for forming the plates are not particularly limited, it is desirable, for example, to make the wall thickness within the range of approximately 1 mm to 10 mm and to manufacture the plates by using aluminum or copper as a material of the plates.

Further, the plates are processed by performing a pressing process or a cutting process. When the plates are processed by performing a pressing process, a plate of which the thickness is equal to or smaller than 5 mm, which makes the pressing process possible, may be used. When the plates are processed by performing a cutting process, a plate of which the thickness is 5 mm or larger may be used.

Each of the partial flow paths 53_1*a* to 53_4*a* and the partial flow paths 53_6*a* is a through hole and has a circular cross-section.

Each of the partial flow paths 53_5*a*, the partial flow paths 53_2*b*, and the partial flow path 53_4*b* is a linear-shaped (e.g., Z-shaped or S-shaped) penetrating groove of which the height of one end is different from the height of the other end in the gravity direction.

To the partial flow path 53_1*a*, the refrigerant pipe (not illustrated) is connected via the connection pipe 52.

To each of the partial flow paths 53_6*a*, a different one of the windward heat transfer tubes 22 is connected via a corresponding one of connection pipes 57.

Each of the connection pipes 57 may be a round pipe, for example.

An alternative arrangement is also acceptable in which each of the partial flow paths 53_6*a* is a through hole shaped to fit the outer circumferential surface of a corresponding one of the windward heat transfer tubes 22, and the windward heat transfer tubes 22 are directly connected to the through holes without using the connection pipes 57 between the windward heat transfer tubes 22 and the through holes.

The partial flow path 54_1*a* formed in the second plate 54_1 is formed in the position facing the partial flow path 53_1*a* formed in the first plate 53_1.

The partial flow paths 54_5*a* formed in the second plate 54_5 are formed in the positions facing the partial flow paths 53_6*a* formed in the first plate 53_6.

The one end and the other end of each of the partial flow paths 53_2*b* formed in the first plate 53_2 are positioned to face corresponding ones of the partial flow paths 54_2*a* formed in the second plate 54_2 that is stacked adjacent to a surface of the first plate 53_2 close to the windward heat exchanging part 21.

A certain part (e.g., a central part) positioned between the one end and the other end of each of the partial flow paths 53_2*b* formed in the first plate 53_2 is positioned to face a corresponding one of the partial flow paths 54_2*a* formed in the second plate 54_2 that is stacked adjacent to the surface of the first plate 53_2 close to the windward heat exchanging part 21.

The one end and the other end of the partial flow path 53_4*b* formed in the first plate 53_4 are positioned to face corresponding ones of the partial flow paths 54_2*a* formed in the second plate 54_3 that is stacked adjacent to a surface of the first plate 53_4 far from the windward heat exchanging part 21.

A certain part (e.g., a central part) positioned between the one end and the other end of the partial flow path 53_4*b* formed in the first plate 53_4 is positioned to face a corresponding one of the partial flow paths 54_2*a* formed in the second plate 54_3 that is stacked adjacent to the surface of the first plate 53_4 far from the windward heat exchanging part 21.

The one end and the other end of each of the partial flow paths 53_5*a* formed in the first plate 53_5 are positioned to face the partial flow paths 54_5*a* formed in the second plate 54_5 that is stacked adjacent to a surface of the first plate 53_5 close to the windward heat exchanging part 21.

A certain part (e.g., a central part) positioned between the one end and the other end of each of the partial flow paths 53_5*a* formed in the first plate 53_5 is positioned to face a corresponding one of the partial flow paths 54_4*a* formed in the second plate 54_4 that is stacked adjacent to a surface of the first plate 53_5 far from the windward heat exchanging part 21.

When the plates are stacked together, the partial flow path 53_1*a*, the partial flow path 54_1*a*, the partial flow path 53_2*a*, one of the partial flow paths 54_2*a*, one of the partial flow paths 53_3*a*, one of the partial flow paths 54_3*a*, and the partial flow path 53_4*b* communicate with one another so that a single flow path, namely, a first distributing and combining flow path 51*a*_1 is formed.

When the plates are stacked together, the partial flow path 53_4*b*, two of the partial flow paths 54_3*a*, two of the partial flow paths 53_3*a*, two of the partial flow paths 54_2*a*, and the partial flow paths 53_2*b* communicate with one another so that two flow paths, namely, second distributing and combining flow paths 51*a*_2 are formed.

When the plates are stacked together, the partial flow paths 53_2*b*, four of the partial flow paths 54_2*a*, four of the partial flow paths 53_3*a*, four of the partial flow paths 54_4*a*, and the partial flow paths 53_5*a* communicate with one another so that four flow paths, namely, third distributing and combining flow paths 51*a*_3 are formed.

When the plates are stacked together, the partial flow paths 53_5*a*, the partial flow paths 54_5*a*, and the partial flow paths 53_6*a* communicate with one another so that eight flow paths, namely, fourth distributing and combining flow paths 51*a*_4 are formed.

<Flows of Refrigerant in Stacked Header 51_1>

Next, the distributing and combining flow paths and flows of the refrigerant inside the stacked header 51_1 will be explained.

While the refrigerant is flowing in the direction indicated by the arrows in the drawing, the first to the fourth distributing and combining flow paths 51*a*_1 to 51*a*_4 serve as distributing flow paths. On the other hand, while the refrigerant is flowing in the direction opposite to the direction indicated by the arrows in the drawing, the first to the fourth distributing and combining flow paths 51*a*_1 to 51*a*_4 serve as combining flow paths.

First, the case in which the first to the fourth distributing and combining flow paths 51*a*_1 to 51*a*_4 serve as distributing flow paths will be explained.

The refrigerant having flowed into the partial flow path 53_1*a* via the connection pipe 52 passes through the first distributing and combining flow path 51*a*_1, flows into a certain part (e.g., the central part) between the one end and the other end of the partial flow path 53_4*b*, collides with the surface of the second plate 54_4, and is then divided into two directions, namely upward and downward, in the gravity direction. The refrigerant having been divided into the two flows passes to reach the one end and the other end of the partial flow path 53_4*b* and flows into the pair of second distributing and combining flow paths 51*a*_2.

The refrigerant having flowed into the second distributing and combining flow paths 51*a*_2 passes straight through the second distributing and combining flow paths 51*a*_2, in the direction opposite to the direction of the refrigerant passing through the first distributing and combining flow path 51*a*_l. This refrigerant collides with the surface of the second plate 54_1 on the inside of the partial flow paths 53_2*b* formed in the first plate 53_2 and is then divided into two directions, namely upward and downward, in the gravity direction. The refrigerant having been divided into the two flows passes to reach the one end and the other end of each of the partial flow paths 53_2*b* and then flows into the four third distributing and combining flow paths 51*a*_3.

The refrigerant having flowed into the third distributing and combining flow paths 51*a*_3 passes straight through the third distributing and combining flow paths 51*a*_3, in the direction opposite to the direction of the refrigerant passing through the second distributing and combining flow paths 51*a*_2, This refrigerant collides with the surface of the second plate 54_5 on the inside of the partial flow paths 53_5*b* formed in the first plate 53_5 and is then divided into two directions, namely upward and downward, in the gravity direction. The refrigerant having been divided into the two flows passes to reach the one end and the other end of the third distributing and combining flow paths 51*a*_3 and then flows into the eight fourth distributing and combining flow paths 51*a*_4.

The refrigerant having flowed into the fourth distributing and combining flow paths 51*a*_4 passes straight through the fourth distributing and combining flow paths 51*a*_4, in the direction opposite to the direction of the refrigerant passing through the third distributing and combining flow paths 51*a*_3, Subsequently, the refrigerant flows out from the fourth distributing and combining flow paths 51*a*_4 and flows into the connection pipes 57.

Next, the case in which the first to the fourth distributing and combining flow paths 51*a*_1 to 51*a*_4 serve as combining flow paths will be explained.

The refrigerant having flowed into the partial flow paths 53_6*a* through the connection pipes 57 passes through the fourth distributing and combining flow paths 51*a*_4, flows into the one end and the other end of each of the partial flow paths 53_5*a* and is then combined together, for example, at a central part of each of the partial flow paths 53_5*a*. The combined refrigerant flows into the third distributing and combining flow paths 51*a*_3. The refrigerant having flowed into the third distributing and combining flow paths 51*a*_3 passes straight through the third distributing and combining flow paths 51*a*_3. This refrigerant flows into the one end and the other end of each of the partial flow paths 53_2*b* and is then combined together, for example, at a central part of each of the partial flow paths 53_2*b*. The combined refrigerant flows into the second distributing and combining flow paths 51*a*_2 and passes straight through the second distributing and combining flow paths 51*a*_2 in the direction opposite to the direction of the refrigerant passing through the third distributing and combining flow paths 51*a*_3.

The refrigerant passing straight through the second distributing and combining flow paths 51*a*_2 flows into the one end and the other end of the partial flow path 53_4*b* and is then combined together, for example, at a central part of the partial flow path 53_4*b*. The combined refrigerant flows into the first distributing and combining flow path 51*a*_1. The refrigerant having flowed into the first distributing and combining flow path 51*a*_1 passes straight through the first distributing and combining flow path 51*a*_1, in the direction opposite to the direction of the refrigerant passing through the second distributing and combining flow paths 51*a*_2. After that, the refrigerant flows out from the first distributing and combining flow path 51*a*_1 and flows into the connection pipe 52.

In the above paragraphs, the example of the stacked header 51_1 is explained in which the refrigerant is branched eight ways by passing through the branching flow paths three times; however, the number of times of branching is not particularly limited.

Further, the first plates 53_1 to 53_6 may be stacked together directly without having the second plates 54_1 to 54_5 alternately interposed between the first plates 53_1 to 53_6. When the first plates 53_1 to 53_6 are stacked together with the second plates 54_1 to 54_5 alternately interposed between the first plates 53_1 to 53_6, the partial flow paths 54_1*a* to 54_5*a* serve as refrigerant isolating flow paths, and it is thus possible to ensure that the flows of the refrigerant passing through the distributing and combining flow paths are isolated from one another. Alternatively, it is also acceptable to directly stack together plates in each of which a first plate and a second plate stacked adjacent to the first plate are integrally formed.

As illustrated in FIG. 2, by stacking the plates together, the stacked header 51_1 is assembled.

Incidentally, while the heat exchanger 1_1 is being used as an evaporator, the temperature of the refrigerant flowing through the heat exchanging part 2 is lower than the temperature of the outdoor air. As a result, the surface temperature of the stacked header 51_1 becomes lower than the dew point temperature of the air. Consequently, as illustrated in FIG. 3, water drops (condensed water W) adhere to the surface of the stacked header 51_1.

As illustrated in FIG. 3(*a*), in the conventional stacked header 510, the upper end part 510A is a horizontal face part. For this reason, the condensed water W adhering to the upper end part 510A of the stacked header 510 stagnates at the upper end part 510A and does not flow downward. Because the condensed water W stagnates, the stacked header 510 may be corroded. Also, when the condensed water W freezes, another part (e.g., another stacked header) positioned close to the stacked header 510 may be deformed.

In contrast, as illustrated in FIG. 1, FIG. 2 and FIG. 3(*b*), in the stacked header 51_1, the upper end part 51_1A is a non-horizontal face part having a non-horizontal face slanted to a horizontal plane. For this reason, even when the condensed water N adheres to the upper end part 51_1A of the stacked header 51_1, the condensed water W flows downward along the surface of the upper end part 51_1A. In particular, because the upper end part 51_1A is formed to have an arc-shaped cross-section, the condensed water W adhering to the upper end part 51_1A flows downward along the arc. Thus, the condensed water W can smoothly descend to be discharged, without stagnating at the upper end part 51_1A. Consequently, by using the stacked header 51_1, it is possible to prevent the condensed water W from stagnating at the upper end part 51_1A. It is therefore possible to prevent the stacked header 51_1 from being corroded and to provide the heat exchanger 1_1 having high reliability.

As illustrated in FIG. 2, by making the upper end of each of the plates have an arc shape, the upper end part 51_1A having a semi-circular columnar shape is formed as illustrated in FIG. 1. In other words, the upper end part 51_1A is formed to have a curved face descending from a centerline of the upper end part 51_1A extending parallel to the flowing direction of the refrigerant, windward and leeward in the passage direction (indicated with the outlined arrow in the drawing) of the air passing through the heat exchanging part 2. In other words, the upper end part 51_1A is formed to have a face descending in the two directions orthogonal to the flowing direction (the flow paths) of the refrigerant, and the flowing direction (the flow paths) serves as the boundary between the two directions.

It should be noted, however, that it is only required that the upper end part 51_1A is a non-horizontal face part. The apex of the arc-shaped part at the upper end of each of the plates does not necessarily have to be positioned on the centerline of the upper end part 51_1A extending parallel to the flowing direction of the refrigerant.

Figure 4:
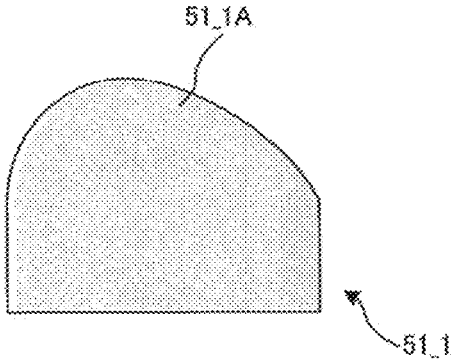
FIG. 4 is a schematic drawing of an example of a shape of an upper end part of the stacked header included in the heat exchanger according to Embodiment 1.

For example, it is not necessary to make the upper end of each of the plates have an arc shape in a strict sense. As illustrated in FIG. 4, it is acceptable to have the apex positioned either windward or leeward.

Figure 5:
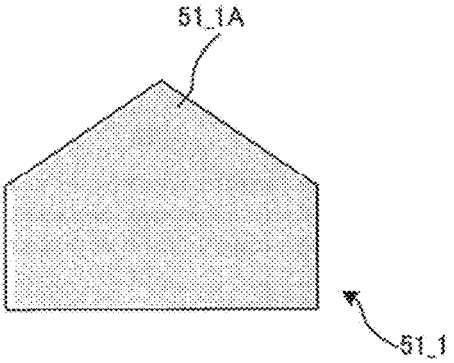
FIG. 5 is a schematic drawing of an example of the shape of the upper end part of the stacked header included in the heat exchanger according to Embodiment 1.

Further, it is not necessary to form the upper end part 51_1A as a curved face. As illustrated in FIG. 5, it is acceptable to form the upper end part 51_1A as slanted flat faces.

Figure 6:
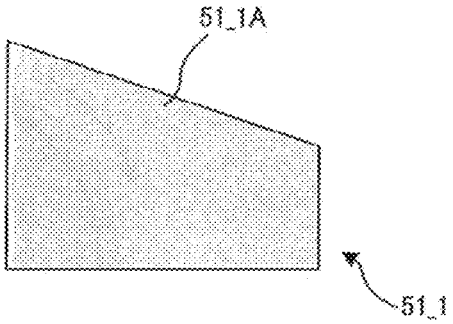
FIG. 6 is a schematic drawing of an example of the shape of the upper end part of the stacked header included in the heat exchanger according to Embodiment 1.

Furthermore, as illustrated in FIG. 6, it is also acceptable to make the upper end part 51_1A slanted in one direction, with different heights of the lateral faces of the flow path forming part 51_10, which are continuous to the upper end part 51_1A.

Figure 7:
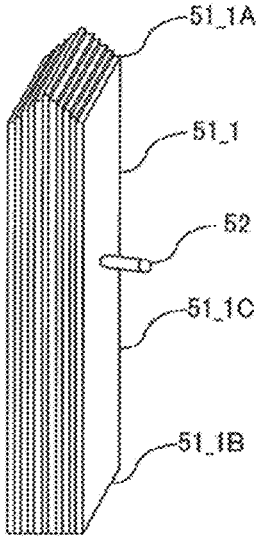
FIG. 7 is a schematic drawing of an example of the shape of the upper end part of the stacked header included in the heat exchanger according to Embodiment 1.

Further, as illustrated in FIG. 7, with different lengths of the plates in the longitudinal direction, it is also acceptable to make the upper end part 51_1A have a shape descending from a centerline of the upper end part 51_1A extending parallel to the passage direction (indicated with the outlined arrow in the drawing) of the air passing through the heat exchanging part 2, windward and leeward in the flowing direction of the refrigerant. In other words, the upper end part 51_1A is shaped to descend in the flowing directions (the flow paths) of the refrigerant, and a middle part of the flowing directions (the flow paths) of the refrigerant serves as a boundary between the directions.

In this case, it is also possible to imagine that the upper end of each of the plates may have a horizontal plane. However, it is only required that the upper end part 51_1A is a non-horizontal face part, when the upper end part 51_1A having been assembled is viewed as a whole.

Figure 8:
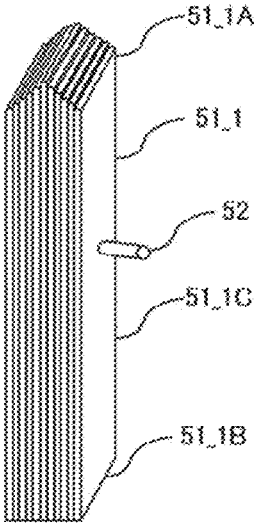
FIG. 8 is a schematic drawing of an example of the shape of the upper end part of the stacked header included in the heat exchanger according to Embodiment 1.

However, it should be noted that, as illustrated in FIG. 8, it is possible to better prevent the condensed water W from stagnating, by making the upper end of each of the plates have a curved face or slanted, with different lengths of the plates in the longitudinal direction.

In the stacked header 51_1 having the upper end part 51_1A illustrated in FIG. 4 to FIG. 6, the orientation of the upper end part 51_1A is not limited by either the passage direction (indicated with the outlined arrow in the drawing) of the air passing through the heat exchanging part 2 or the flowing direction of the refrigerant. It is desirable to determine the installation orientation of the upper end part 51_1A as appropriate, while the flow of the condensed water W is taken into consideration.

Further, the upper end part 51_1A of the stacked header 51_1 may be formed to have a dome shape. Alternatively, the upper end part 51_1A of the stacked header 51 _1 may be formed to have a triangular cross-section or an oval cross-section. In other words, it is only required that the upper end part 51_1A is formed not to have a horizontal face part where the condensed water can stagnate.

<Configuration of Cylindrical Header>

Next, a configuration of the cylindrical header included in the heat exchanger according to Embodiment 1 will be explained.

Figure 9:
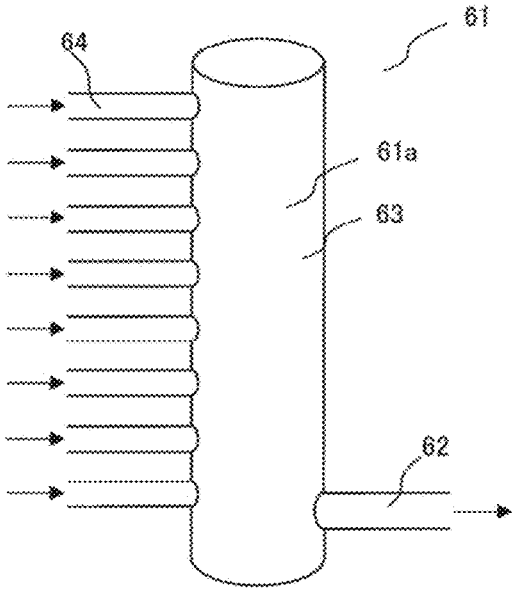
FIG. 9 is a perspective view of a cylindrical header included in the heat exchanger according to Embodiment 1.

FIG. 9 is a perspective view of the cylindrical header included in the heat exchanger according to Embodiment 1. In FIG. 9, the arrows indicate flows of the refrigerant observed while the distributing and combining flow path 61*a* of the cylindrical header 61 is serving as a combining flow path.

As illustrated in FIG. 9, in the cylindrical header 61, a circular cylinder part 63 of which one end and the other end are closed is provided in such a manner that the axial direction of the circular cylinder part 63 extends parallel to the gravity direction. However, the axial direction of the circular cylinder part 63 does not necessarily have to extend parallel to the gravity direction. By placing the cylindrical header 61 in such a manner that the axial direction of the circular cylinder part 63 is parallel to the longitudinal direction of the stacked header 51_1, it is possible to reduce the space required by the distributing and combining part 3. Alternatively, the circular cylinder part 63 may be a cylinder part having an oval cross-section, for example.

To the lateral wall of the circular cylinder part 63, the refrigerant pipe (not illustrated) is connected via the connection pipe 62. To the lateral wall of the circular cylinder part 63, the leeward heat transfer tubes 32 are connected via a plurality of connection pipes 64. Each of the connection pipes 64 may be a round pipe, for example. The leeward heat transfer tubes 32 may be directly connected to the lateral wall of the circular cylinder part 63, without using the connection pipes 64 between the leeward heat transfer tubes 32 and the lateral wall. The circular cylinder part 63 has the distributing and combining flow path 61*a* inside the circular cylinder part 63. While the refrigerant is flowing in the direction indicated by the arrows in the drawing, the distributing and combining flow path 61*a* serves as a combining flow path. On the other hand, while the refrigerant is flowing in the direction opposite to the direction indicated by the arrows in the drawing, the distributing and combining flow path 61*a* serves as a distributing flow path.

While the distributing and combining flow path 61*a* is serving as a combining flow path, the refrigerant having flowed into the plurality of connection pipes 64 is combined together, by passing through the inside of the circular cylinder part 63 and flowing into the connection pipe 62. While the distributing and combining flow path 61*a* is serving as a distributing flow path, the refrigerant having flowed into the connection pipe 62 is distributed by passing through the inside of the circular cylinder part 63 and flowing into the plurality of connection pipes 64.

It is desirable to connect the connection pipe 62 and the plurality of connection pipes 64 in such a manner that, in the circumferential direction of the circular cylinder part 63, the direction in which the connection pipe 62 is connected and the direction in which the plurality of connection pipes 64 are connected are not along the same straight line. With this arrangement, while the distributing and combining flow path 61*a* is serving as a distributing flow path, it is possible to cause the refrigerant to flow into the plurality of connection pipes 64 more evenly.

<Connection Between Heat Exchanging Part 2 and Distributing and Combining Part 3>

Next, the connection between the heat exchanging part 2 and the distributing and combining part 3 included in the heat exchanger 1_1 according to Embodiment 1 will be explained.

Figure 10:
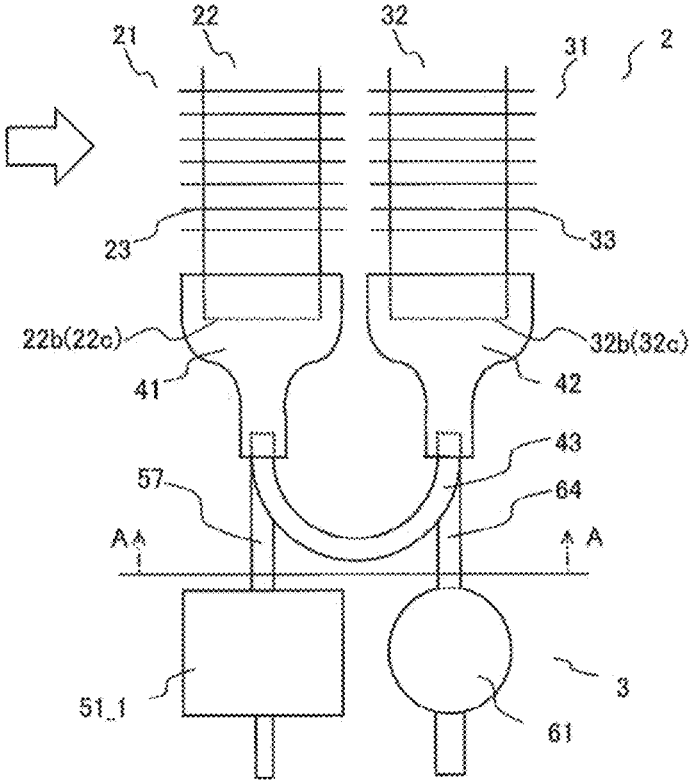
FIG. 10 is a drawing for explaining connection between a heat exchanging part and a distributing and combining part included in the heat exchanger according to Embodiment 1.
Figure 11:
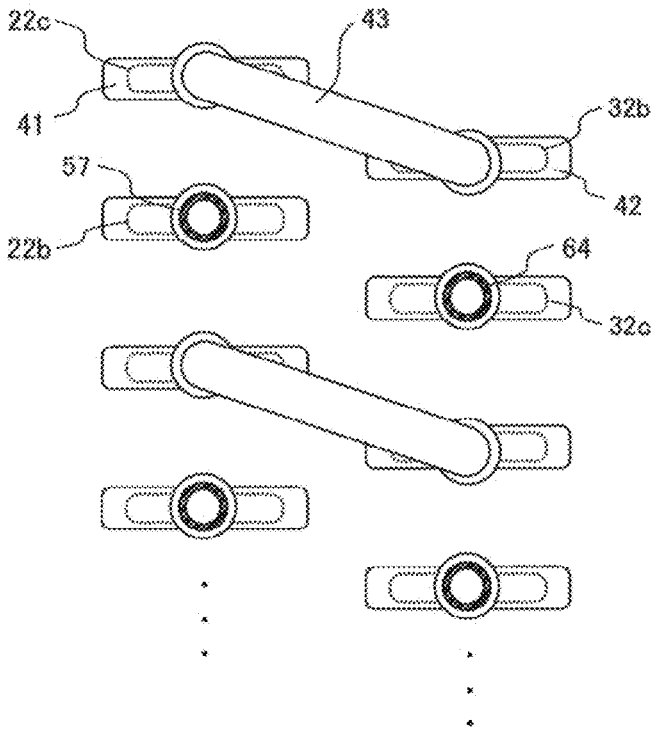
FIG. 11 is a drawing for explaining the connection between the heat exchanging part and the distributing and combining part included in the heat exchanger according to Embodiment 1.

FIG. 10 and FIG. 11 are drawings for explaining the connection between the heat exchanging part and the distributing and combining part included in the heat exchanger according to Embodiment 1. FIG. 11 is a cross-sectional view taken along line A-A in FIG. 10.

As illustrated in FIG. 10 and FIG. 11, a windward joint part 41 is joined to each of one end 22*b* and the other end 22*c* of each of the windward heat transfer tubes 22 each formed to have a substantially U-shape. A flow path is formed on the inside of the windward joint part 41. One end of the flow path is formed to fit the outer circumferential surface of the windward heat transfer tube 22, whereas the other end of the flow path has a circular shape.

Similarly, a leeward joint part 42 is joined to each of one end 32*b* and the other end 32*c* of each of the leeward heat transfer tubes 32 each formed to have a substantially U-shape. A flow path is formed on the inside of the leeward joint part 42. One end of the flow path is formed to fit the outer circumferential surface of the leeward heat transfer tube 32, whereas the other end of the flow path has a circular shape.

Each of the windward joint parts 41 joined to the other end 22*c* of a corresponding one of the windward heat transfer tubes 22 is connected, via a liaison pipe 43, to a corresponding one of the leeward joint parts 42 joined to the one end 32*b* of a corresponding one of the leeward heat transfer tubes 32. The liaison pipe 43 may be a round pipe bent in an arc shape, for example. To each of the windward joint parts 41 joined to the one end 22*b* of a corresponding one of the windward heat transfer tubes 22, a corresponding one of the connection pipes 57 of the stacked header 51_1 is connected. To each of the leeward joint parts 42 joined to the other end 32*c* of a corresponding one of the leeward heat transfer tubes 32, a corresponding one of the connection pipes 64 of the cylindrical header 61 is connected.

Alternatively, each of the windward joint parts 41 and a corresponding one of the connection pipes 57 may be integrally formed. Further, each of the leeward joint parts 42 and a corresponding one of the connection pipes 64 may be integrally formed. Also, each of the windward joint parts 41, a corresponding one of the leeward joint parts 42, and a corresponding one of the liaison pipes 43 may be integrally formed.

<Configuration of Air-Conditioning Apparatus 91 in which Heat Exchanger 1_1 is used>

Next, a configuration of the air-conditioning apparatus 91 in which the heat exchanger 1_1 according to Embodiment 1 is used will be explained.

Figure 12:
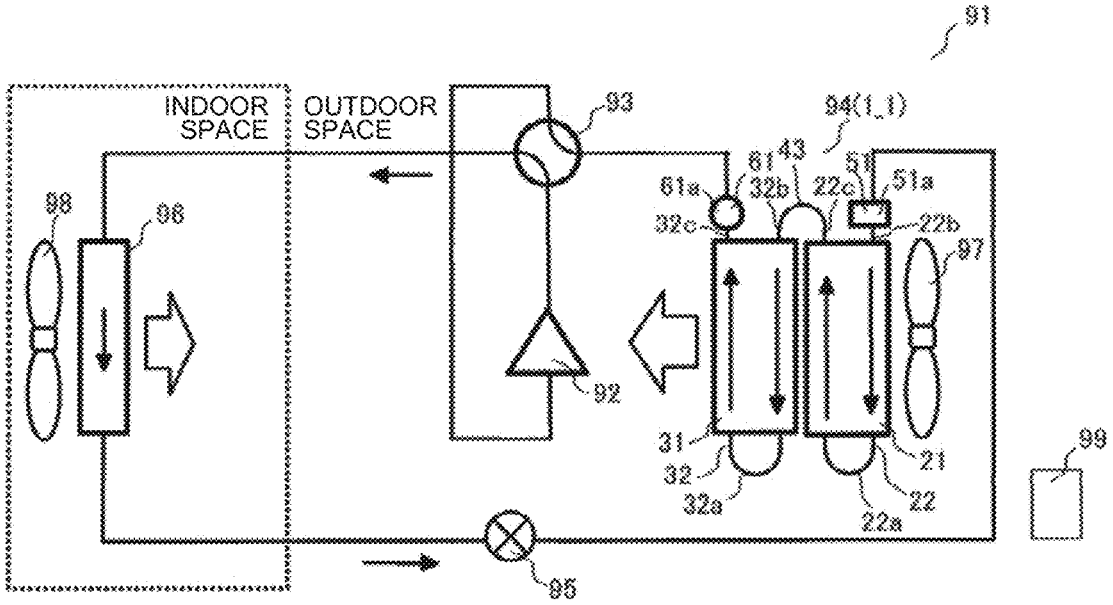
FIG. 12 is a schematic diagram of a configuration of an air-conditioning apparatus in which the heat exchanger according to Embodiment 1 is used.
Figure 13:
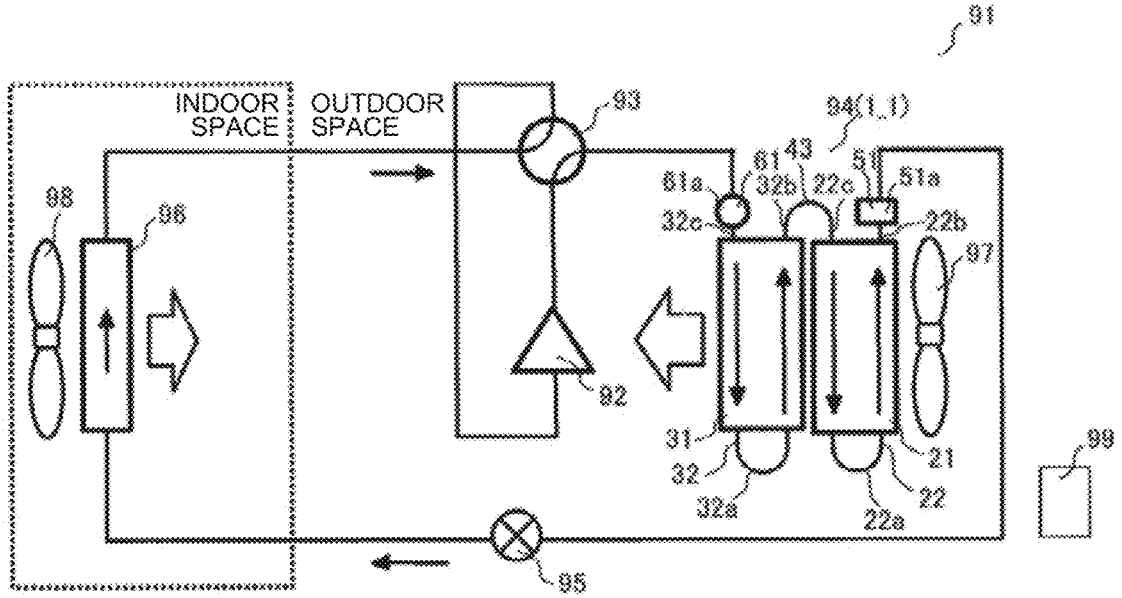
FIG. 13 is a schematic diagram of the configuration of the air-conditioning apparatus in which the heat exchanger according to Embodiment 1 is used.

FIG. 12 and FIG. 13 are schematic diagrams of the configuration of the air-conditioning apparatus 91 in which the heat exchanger 1_1 according to Embodiment 1 is used. FIG. 12 illustrates a flow of the refrigerant observed while the air-conditioning apparatus 91 is performing a heating operation. FIG. 13 illustrates a flow of the refrigerant observed while the air-conditioning apparatus 91 is performing a cooling operation.

As illustrated in FIG. 12 and FIG. 13, the air-conditioning apparatus 91 includes a compressor 92, a four-way valve 93, an outdoor heat exchanger (a heat source side heat exchanger) 94, an expansion device 95, an indoor heat exchanger (a load side heat exchanger) 96, an outdoor fan (a heat source side fan) 97, an indoor fan (a load side fan) 98, and a controller 99. The compressor 92, the four-way valve 93, the outdoor heat exchanger 94, the expansion device 95, and the indoor heat exchanger 96 are connected together by refrigerant pipes to form a refrigerant cycle circuit. Alternatively, the four-way valve 93 may be another flow path switching device such as a two-way valve, a three-way valve, and a device combining these valves as appropriate.

The outdoor heat exchanger 94 is the heat exchanger 1_1 illustrated in FIG. 1 to FIG. 11. The heat exchanger 1_1 is installed in such a manner that the stacked header 51_1 is provided windward and the cylindrical header 61 is provided leeward in the airflow generated by driving of the outdoor fan 97. The outdoor fan 97 may be provided windward of the heat exchanger 1_1 or may be provided leeward of the heat exchanger 1_1.

To the controller 99, for example, the compressor 92, the four-way valve 93, the expansion device 95, the outdoor fan 97, the indoor fan 98, various types of sensors, and other elements are connected. The controller 99 switches between the heating operation and the cooling operation by switching the flow paths of the four-way valve 93.

<Operations of Heat Exchanger 1_1 and Air-Conditioning Apparatus 91>

Next, operations of the heat exchanger 1_1 according to Embodiment 1 and the air-conditioning apparatus 91 in which the heat exchanger 1_1 is used will be explained.

<Operations of Heat Exchanger 1_1 and Air-Conditioning Apparatus 91 During Heating Operation>

Next, a flow of the refrigerant observed during the heating operation will be explained, with reference to FIG. 12.

The refrigerant having high pressure and high temperature and being in a gas state is discharged from the compressor 92, flows into the indoor heat exchanger 96 via the four-way valve 93, is condensed by exchanging heat with the air supplied by the indoor fan 98, and thus heats the inside of a room. The refrigerant having been condensed by the indoor heat exchanger 96 is brought into a subcooled liquid state having high pressure, flows out of the indoor heat exchanger 96, and is caused by the expansion device 95 to be refrigerant in a two-phase gas-liquid state having low pressure.

The refrigerant brought into the two-phase gas-liquid state having low pressure by the expansion device 95 flows into the outdoor heat exchanger 94, exchanges heat with the air supplied by the outdoor fan 97, and evaporates. The refrigerant having been evaporated by the outdoor heat exchanger 94 is brought into a superheated gas state having low pressure, flows out of the outdoor heat exchanger 94, and is sucked into the compressor 92 via the four-way valve 93. In other words, during the heating operation, the outdoor heat exchanger 94 operates as an evaporator.

In the outdoor heat exchanger 94, the refrigerant flows in to be distributed to the distributing and combining flow path 51*a* of the stacked header 51_1 and flows into the one end 22*b* of each of the windward heat transfer tubes 22 included in the windward heat exchanging part 21. The refrigerant having flowed into the one end 22*b* of each of the windward heat transfer tubes 22 passes through a corresponding one of the folded parts 22*a*, reaches the other end 22*c* of each of the windward heat transfer tubes 22, and flows into the one end 32*b* of each of the leeward heat transfer tubes 32 included in the leeward heat exchanging part 31 via each of the liaison pipes 43. The refrigerant having flowed into the one end 32*b* of each of the leeward heat transfer tubes 32 passes through a corresponding one of the folded parts 32*a*, reaches the other end 32*c* of each of the leeward heat transfer tubes 32, and is combined together to flow into the distributing and combining flow path 61*a* of the cylindrical header 61.

While the outdoor heat exchanger 94 is being used as an evaporator, the temperature of the refrigerant may become lower than the temperature of the outdoor air. As a result, the surface temperature of the stacked header 51_1 becomes lower than the dew point temperature of the air, and water drops (condensed water) adhere to the surface of the stacked header 51_1. Because the upper end part 51_1A of the stacked header 51_1 is the non-horizontal face part, the condensed water generated at the upper end part 51_1A of the stacked header 51_1 flows downward along the surface of the upper end part 51_1A of the stacked header 51_1. Consequently, the condensed water smoothly descends without stagnating at the upper end part 51_1A of the stacked header 51_1.

Consequently, it is possible to prevent the condensed water from stagnating at the upper end part 51_1A of the stacked header 51_1. It is therefore possible to prevent the stacked header 51_1 from being corroded by a long-term stagnation of the condensed water. Consequently, it is therefore possible to provide the heat exchanger 1_1 having high reliability.

<Operations of Heat Exchanger 1_1 and Air-Conditioning Apparatus 91 During Cooling Operation>

Next, a flow of the refrigerant observed during the cooling operation will be explained, with reference to FIG. 13.

The refrigerant having high pressure and high temperature and being in a gas state is discharged from the compressor 92, flows into the outdoor heat exchanger 94 via the four-way valve 93, and is condensed by exchanging heat with the air supplied by the outdoor fan 97. The refrigerant having been condensed by the outdoor heat exchanger 94 is brought into a subcooled liquid state having high pressure (or a two-phase gas-liquid state having low quality), flows out of the outdoor heat exchanger 94, and is caused by the expansion device 95 to be in a two-phase gas-liquid state having low pressure.

The refrigerant brought into the two-phase gas-liquid state having low pressure by the expansion device 95 flows into the indoor heat exchanger 96, is evaporated by exchanging heat with the air supplied by the indoor fan 98, and thus cools the inside of the room. The refrigerant having been evaporated by the indoor heat exchanger 96 is brought into a superheated gas state having low pressure, flows out of the indoor heat exchanger 96, and is sucked into the compressor 92 via the four-way valve 93. In other words, during the cooling operation, the outdoor heat exchanger 94 operates as a condenser.

In the outdoor heat exchanger 94, the refrigerant flows in to be distributed to the distributing and combining flow path 61*a* of the cylindrical header 61 and flows into the other end 32*c* of each of the leeward heat transfer tubes 32 included in the leeward heat exchanging part 31. The refrigerant having flowed into the other end 32*c* of each of the leeward heat transfer tubes 32 passes through a corresponding one of the folded parts 32*a*, reaches the one end 32*b* of each of the leeward heat transfer tubes 32, and flows into the other end 22*c* of each of the windward heat transfer tubes 22 included in the windward heat exchanging part 21, via the liaison pipes 43. The refrigerant having flowed into the other end 22*c* of each of the windward heat transfer tubes 22 passes through a corresponding one of the folded parts 22*a*, reaches the one end 22*b* of each of the windward heat transfer tubes 22, and is combined together to flow into the distributing and combining flow path 51*a* of the stacked header 51_1.

In Embodiment 1, the stacked header 51_1 is explained as an example of the distributor; however, the structure of the upper end part 51_1A described in Embodiment 1 is also applicable to flow paths of distributors and distributing devices using pipes having a more commonly-used configuration.

Embodiment 2

A distributor, a stacked header, a heat exchanger, and an air-conditioning apparatus according to Embodiment 2 will be explained.

<Configuration of Heat Exchanger 1_2>

In the following sections, a schematic configuration of a heat exchanger 1_2 according to Embodiment 2 will be explained.

Figure 14:
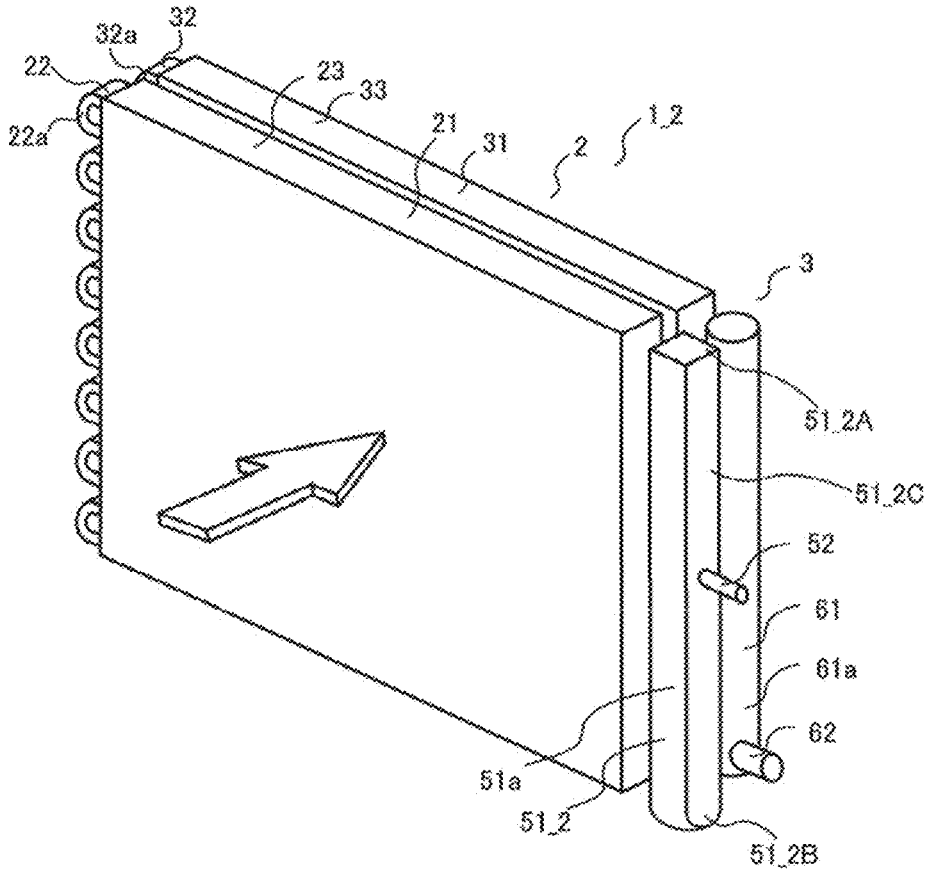
FIG. 14 is a perspective view of a heat exchanger according to Embodiment 2.

FIG. 14 is a perspective view of the heat exchanger 1_2 according to Embodiment 2.

Embodiment 2 will be explained while a focus is placed on differences from Embodiment 1. Some of the parts being the same as those in Embodiment 1 will be referred to by using the same reference signs, and the explanations of the parts will be omitted.

In a stacked header 51_2, an upper end part 51_2A is formed at an upper end of the stacked header 51_2 in the gravity direction, while a lower end part 51_2B is formed at a lower end of the stacked header 51_2 in the gravity direction. A flow path forming part 51_20 is formed between the upper end part 51_2A and the lower end part 51_2B.

The flow path forming part 51_20 has the partial flow paths and the distributing and combining flow paths that are formed in the flow path forming part 51_20 and explained in Embodiment 1.

In Embodiment 1, the example is explained in which the upper end part 51_1A of the stacked header 51_1 is the non-horizontal face part. In Embodiment 2, the shapes of the upper end part 51_2A and the lower end part 51_2B of the stacked header 51_2 are different from those in Embodiment 1. Because the other configurations are the same as those of the distributor, the stacked header 51_1, the heat exchanger 1_1, and the air-conditioning apparatus 91 according to Embodiment 1, the explanations of the other configurations will be omitted.

In other words, in the heat exchanger 1_2 according to Embodiment 2, the upper end part 51_2A of the stacked header 51_2 is a horizontal face part, while the lower end part 51_2B is a non-horizontal face part having a non-horizontal face slanted to a horizontal plane.

<Configuration of Stacked Header 51_2>

Next, a configuration of the stacked header 51_2 included in the heat exchanger 1_2 according to Embodiment 2 will be explained.

Figure 15:
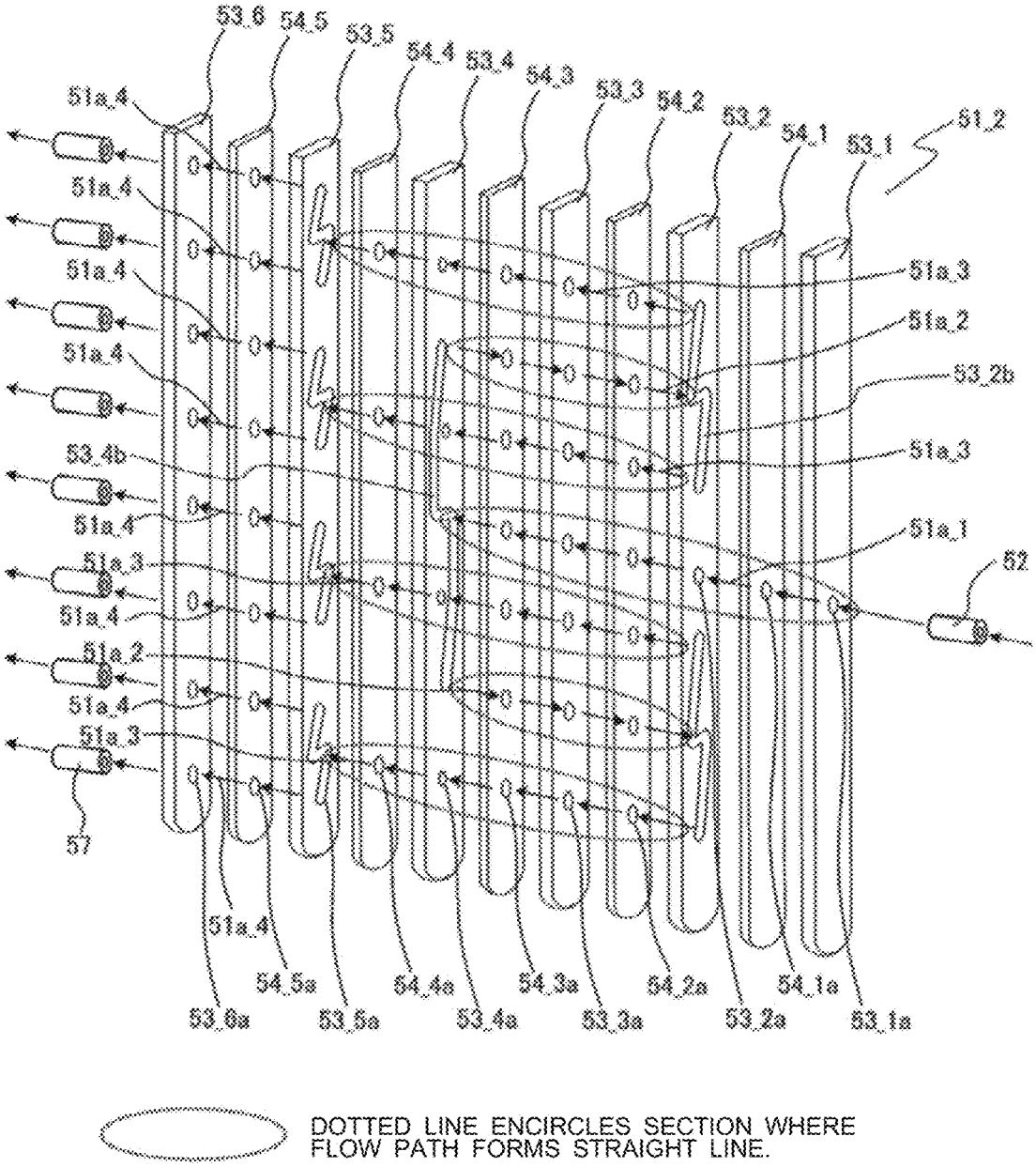
FIG. 15 is a perspective view in an exploded state of a stacked header included in the heat exchanger according to Embodiment 2.
Figure 16:
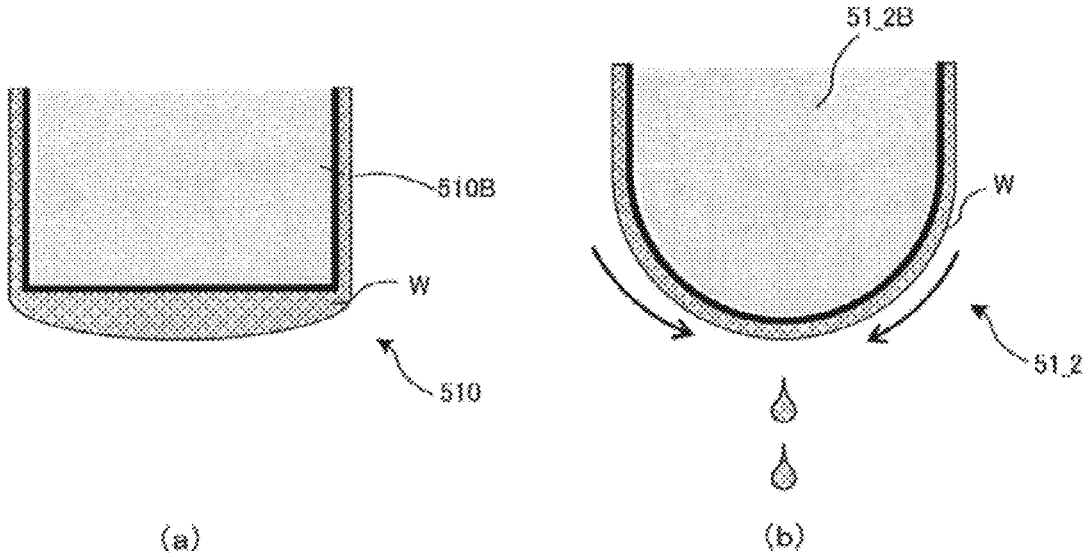
FIG. 16 is an explanatory drawing for explaining a water flow in the stacked header included in the heat exchanger according to Embodiment 2, in comparison to that in a conventional example.

FIG. 15 is a perspective view in an exploded state of the stacked header 51_2 included in the heat exchanger 1_2 according to Embodiment 2. FIG. 16 is an explanatory drawing for explaining a water flow in the stacked header 51_2 included in the heat exchanger 1_2 according to Embodiment 2, in comparison to that in a conventional example.

In FIG. 15, the arrows indicate flows of the refrigerant observed while the distributing and combining flow path 51*a* of the stacked header 51_2 is serving as a distributing flow path.

FIG. 16(*a*) illustrates a lower end part 510E of the conventional stacked header 510, whereas FIG. 16(*b*) illustrates a lower end part 51_2B of the stacked header 51_2.

As illustrated in FIG. 15, similarly to the stacked header 51_1 according to Embodiment 1, the stacked header 51_2 is formed by stacking together the plurality of first plates 53_1 to 53_6 and the plurality of second plates 54_1 to 54_5 alternately interposed between the first plates 53_1 to 53_6.

Further, the stacked header 51_2 is attached to the heat exchanging part 2 in such a manner that the longitudinal direction of the stacked header 51_2 extends parallel to the gravity direction. In the stacked header 51_2, the upper end part 51_2A is formed at the upper end of the stacked header 51_2 in the gravity direction, whereas the lower end part 51_2B is formed at the lower end of the stacked header 51_2 in the gravity direction.

The configurations other than the upper end and the lower end of each of the plates, the partial flow paths formed in the plates, and the distributing and combining flow paths formed as a result of stacking the plates together are the same as those in the stacked header 51_1 according to Embodiment 1.

Further, the flows of the refrigerant in the stacked header 51_2 are also the same as those in the stacked header 51_1 according to Embodiment 1.

As illustrated in FIG. 15, as a result of stacking the plates together, the stacked header 51_2 is assembled.

Incidentally, while the heat exchanger 1_2 is being used as an evaporator, the temperature of the refrigerant flowing through the heat exchanging part 2 is lower than the temperature of the outdoor air. As a result, the surface temperature of the stacked header 51_2 becomes lower than the dew point temperature of the air. Consequently, as illustrated in FIG. 16, water drops (condensed water W) adhere to the surface of the stacked header 51_2.

As illustrated in FIG. 16(*a*), in the conventional stacked header 510, the lower end part 510E is a horizontal face part. For this reason, the condensed water W adhering to the lower end part 510B of the stacked header 510 stagnates at the lower end part 510B due to surface tension and does not easily flow downward. Because the condensed water W stagnates, the stacked header 510 may be corroded. Also, when the condensed water W freezes, another part (e.g., another stacked header) positioned close to the stacked header 510 may be deformed.

In contrast, as illustrated in FIG. 14, FIG. 15, and FIG. 16(*b*), in the stacked header 51_2, the lower end part 51_2B is a non-horizontal face part. For this reason, even when the condensed water W adheres to the lower end part 51_2B of the stacked header 51_2, the condensed water W flows downward along the surface of the lower end part 51_2B. In particular, because the lower end part 51_2B is formed to have an arc shape, the condensed water W adhering to the lower end part 51_26 flows downward along the arc, is collected, and descends. Consequently, the condensed water W smoothly can descend to be discharged, without stagnating at the lower end part 51_2B. As a result, by using the stacked header 51_2, it is possible to prevent the condensed water W from stagnating at the lower end part 51_2B. It is therefore possible to prevent the stacked header 51_2 from being corroded. Consequently, it is possible to provide the heat exchanger 1_2 having high reliability.

As illustrated in FIG. 15, by making the lower end of each of the plates have an arc shape, the lower end part 51_26 having a semi-circular columnar shape is formed as illustrated in FIG. 14. In other words, the lower end part 51_2B is formed to have a curved face descending from a centerline of the lower end part 51_26 extending parallel to the flowing direction of the refrigerant, windward and leeward in the passage direction (indicated with the outlined arrow in the drawing) of the air passing through the heat exchanging part 2.

It should be noted, however, that it is only required that the lower end part 51_2B is a non-horizontal face part. The apex of the arc-shaped part at the upper end of each of the plates does not necessarily have to be positioned on the centerline of the lower end part 51_26 extending parallel to the flowing direction of the refrigerant.

For example, it is acceptable to adopt any of the shapes illustrated in FIG. 4 to FIG. 8 explained in Embodiment 1 as the shape of the lower end part 51_26 of the stacked header 51_2.

Further, the heat exchanger 1_2 according to Embodiment 2 may be installed as the outdoor heat exchanger 94 into the air-conditioning apparatus 91 according to Embodiment 1.

Further, while the outdoor heat exchanger 94 is being used as an evaporator, the temperature of the refrigerant may become lower than the temperature of the outdoor air. As a result, the surface temperature of the stacked header 51_2 becomes lower than the dew point temperature of the air, and water drops (condensed water) adhere to the surface of the stacked header 51_2. Because the lower end part 51_2B of the stacked header 51_2 is the non-horizontal face part, the condensed water generated at the lower end part 51_2B of the stacked header 51_2 flows downward along the surface of the lower end part 51_2B of the stacked header 51_2, is collected, and descends. In this manner, the condensed water smoothly descends without stagnating at the lower end part 51_2B of the stacked header 51_2.

Consequently, it is possible to prevent the condensed water from stagnating at the lower end part 51_2B of the stacked header 51_2. It is therefore possible to prevent the stacked header 51_2 from being corroded by a long-term stagnation of the condensed water. Consequently, it is possible to provide the heat exchanger 1_2 having high reliability.

Further, because the lower end part 51_2B is the non-horizontal face part, it is possible to easily recognize the orientation in the up-and-down directions when the heat exchanger 1_2 is installed. It is therefore possible to save trouble in management and to improve efficiency during the manufacturing procedure.

In Embodiment 2, the stacked header 51_2 is explained as an example of the distributor; however, the structure of the lower end part 51_2B described in Embodiment 2 is also applicable to flow paths of distributors and distributing devices using pipes having a more commonly-used configuration.

Embodiment 3

A distributor, a stacked header, a heat exchanger, and an air-conditioning apparatus according to Embodiment 3 will be explained.

<Configuration of Heat Exchanger 1_3>

In the following sections, a schematic configuration of a heat exchanger 1_3 according to Embodiment 3 will be explained.

Figure 17:
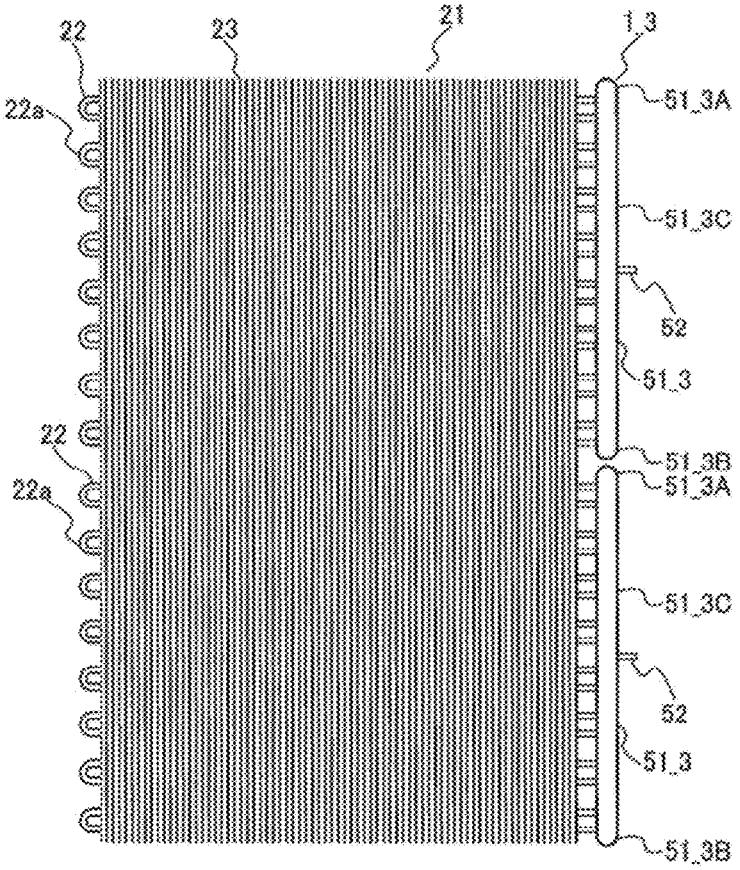
Related Art FIG. 17
FIG. 17 is a lateral view of a heat exchanger according to Embodiment 3.

FIG. 17 is a lateral view of the heat exchanger 1_3 according to Embodiment 3.

Embodiment 3 will be explained while a focus is placed on differences from Embodiments 1 and 2. Some of the parts being the same as those in Embodiments 1 and 2 will be referred to by using the same reference signs, and the explanations of the parts will be omitted.

In the stacked header 51_3, an upper end part 51_3A is formed at an upper end of the stacked header 51_3 in the gravity direction, while a lower end part 51_3B is formed at a lower end of the stacked header 51_3 in the gravity direction. A flow path forming part 51_3C is formed between the upper end part 51_3A and the lower end part 51_3B.

The flow path forming part 51_3C has the partial flow paths and the distributing and combining flow paths that are formed in the flow path forming part 51_3C and explained in Embodiment 1.

In Embodiment 1, the example is explained in which the upper end part 51_1A of the stacked header 51_1 is the non-horizontal face part. In Embodiment 2, the example is explained in which the lower end part 51_2B of the stacked header 51_2 is the non-horizontal face part. In Embodiment 3, both the upper end part 51_3A and the lower end part 51_3B of the stacked header 51_3 are each a non-horizontal face part. Because the other configurations are the same as those of the distributor, the stacked header 51_1, the heat exchanger 1_1, and the air-conditioning apparatus 91 according to Embodiment 1, the explanations of the other configurations will be omitted.

In other words, in the heat exchanger 1_3 according to Embodiment 3, the upper end part 51_3A and the lower end part 51_3B of the stacked header 51_3 are each the non-horizontal face part having a non-horizontal face slanted to a horizontal plane.

Further, as illustrated in FIG. 17, the heat exchanger 1_3 is formed by connecting two or more of the stacked headers 51_3 together in the gravity direction. More specifically, in the heat exchanger 1_3, the lower end part 51_3B of the stacked header 51_3 positioned at an upper point in the gravity direction is positioned close to the upper end part 51_3A of the stacked header 51_3 positioned at a lower point in the gravity direction.

<Configuration of Stacked Headers 51_3>

Next, a configuration of any of the stacked headers 51_3 included in the heat exchanger 1_3 according to Embodiment 3 will be explained.

Figure 18:
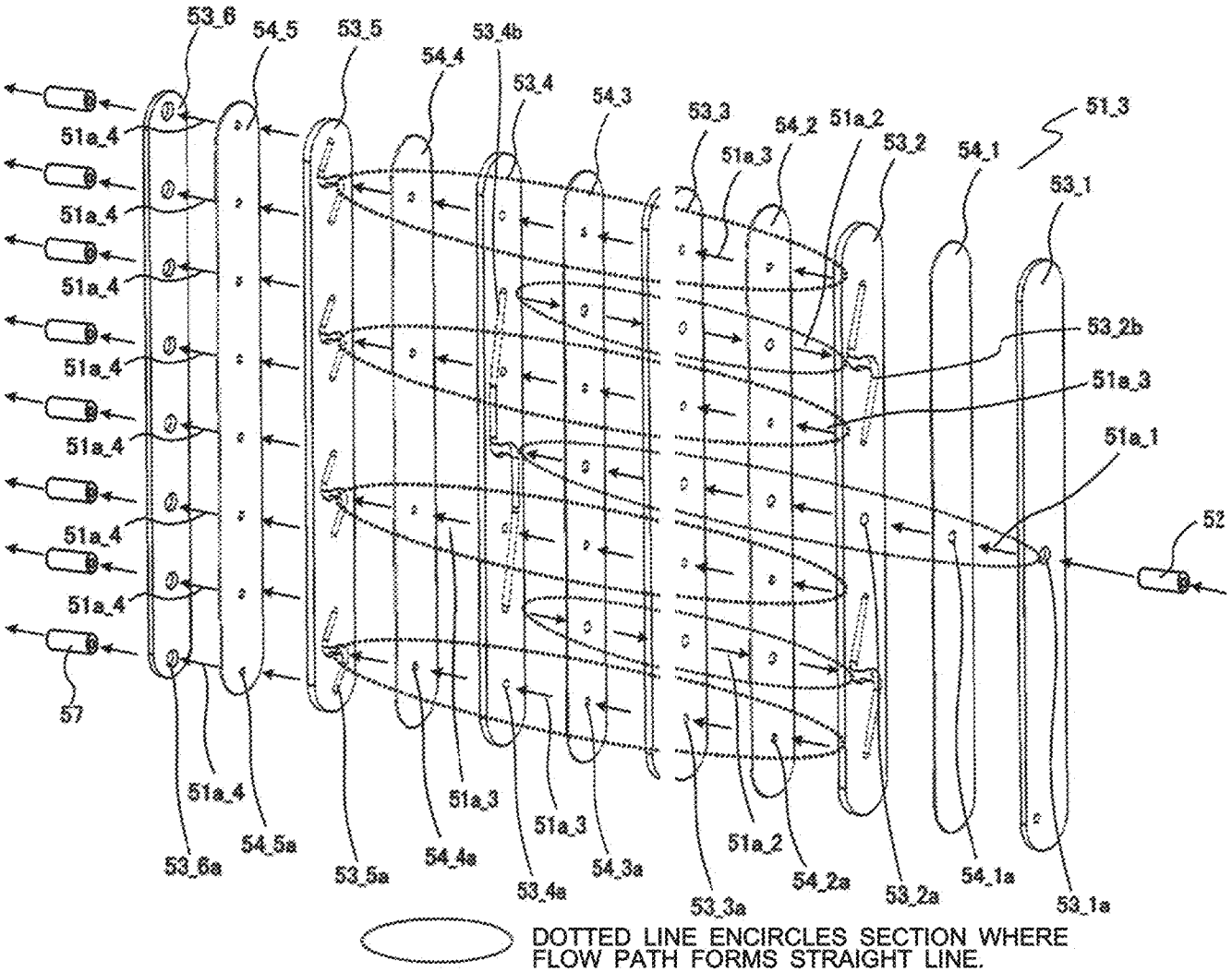
FIG. 18 is a perspective view in an exploded state of any of stacked headers included in the heat exchanger according to Embodiment 3.
Figure 19:
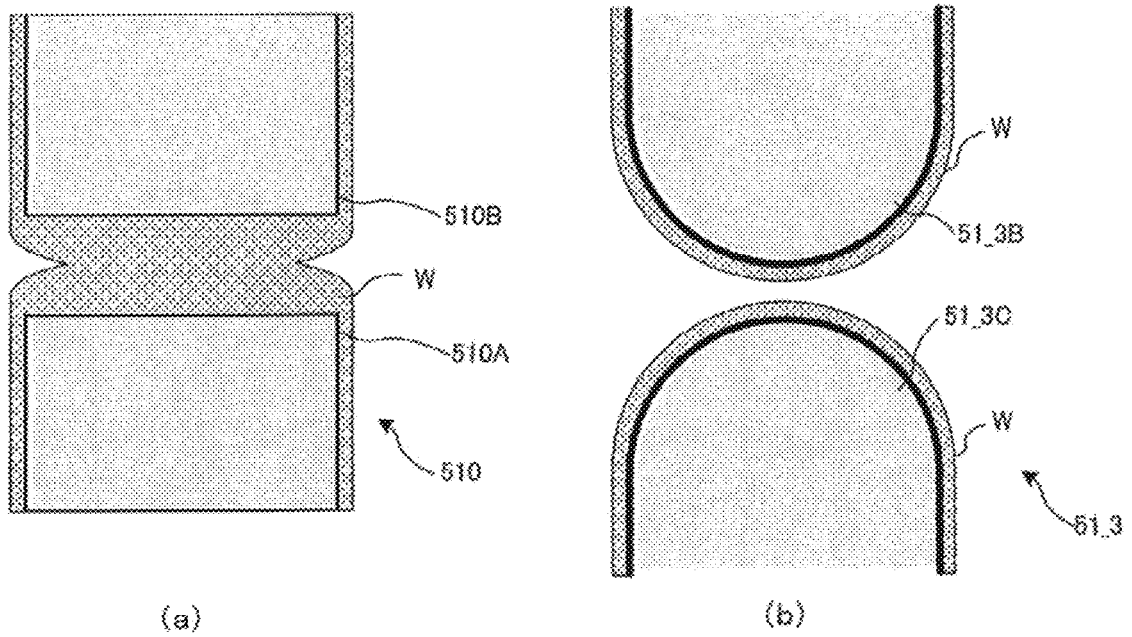
FIG. 19 is an explanatory drawing for explaining a water flow in any of the stacked headers included in the heat exchanger according to Embodiment 3, in comparison to that in a conventional example.
Figure 20:
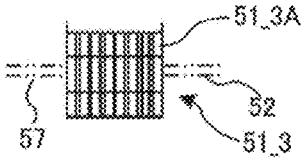
FIG. 20 is a plan view of any of the stacked headers included in the heat exchanger according to Embodiment 3.
Figure 21:
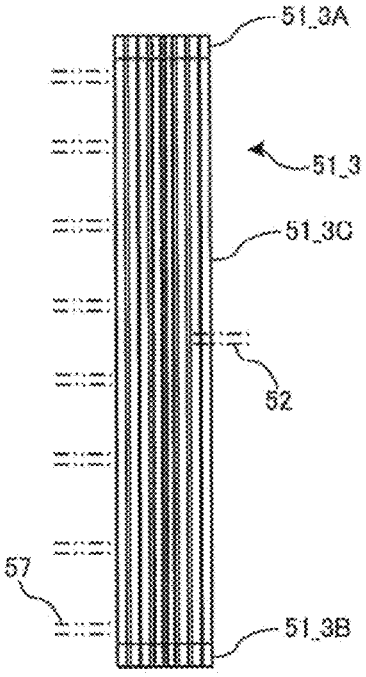
FIG. 21 is a lateral view of any of the stacked headers included in the heat exchanger according to Embodiment 3.
Figure 22:
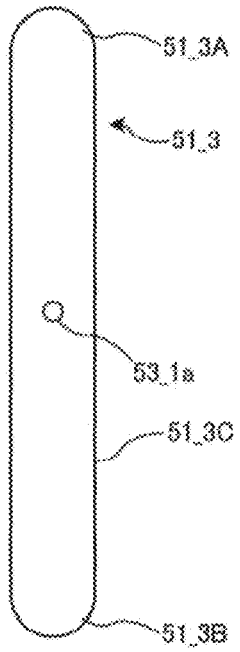
FIG. 22 is a front view of any of the stacked headers included in the heat exchanger according to Embodiment 3.
Figure 23:
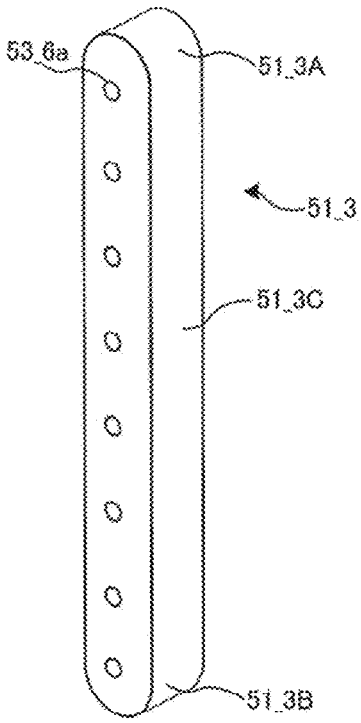
FIG. 23 is a perspective view of any of the stacked headers included in the heat exchanger according to Embodiment 3.

FIG. 18 is a perspective view in an exploded state of any of the stacked headers 51_3 included in the heat exchanger 1_3 according to Embodiment 3. FIG. 19 is an explanatory drawing for explaining a water flow in any of the stacked headers 51_3 included in the heat exchanger 1_3 according to Embodiment 3, in comparison to that in a conventional example. FIG. 20 is a plan view of any of the stacked headers 51_3 included in the heat exchanger 1_3 according to Embodiment 3. FIG. 21 is a lateral view of any of the stacked headers 51_3 included in the heat exchanger 1_3 according to Embodiment 3. FIG. 22 is a front view of any of the stacked headers 51_3 included in the heat exchanger 1_3 according to Embodiment 3. FIG. 23 is a perspective view of any of the stacked headers 51_3 included in the heat exchanger 1_3 according to Embodiment 3.

In FIG. 18, the arrows indicate flows of the refrigerant observed while the distributing and combining flow path 51*a* of any of the stacked headers 51_3 is serving as a distributing flow path.

FIG. 19(*a*) illustrates the upper end part 510A and the lower end part 510B of the conventional stacked header 510, whereas FIG. 19(*b*) illustrates the upper end part 51_3A and the lower end part 51_3B of any of the stacked headers 51_3.

FIG. 20 is a plan view of any of the stacked headers 51_3 as being viewed from above.

FIG. 21 is a lateral view of any of the stacked headers 51_3 as being viewed from either windward or leeward in the passage direction of the air passing through the heat exchanging part 2.

FIG. 22 is a front view of any of the stacked headers 51_3 as being viewed from the flowing direction of the refrigerant.

FIG. 23 is a perspective view of any of the stacked headers 51_3 as being viewed diagonally from above.

As illustrated in FIG. 18, similarly to the stacked header 51_1 according to Embodiment 1, the stacked header 51_3 is formed by stacking together the plurality of first plates 53_1 to 53_6 and the plurality of second plates 54_1 to 54_5 alternately interposed between the first plates 53_1 to 53_6.

Further, the stacked header 51_3 is attached to the heat exchanging part 2 in such a manner that the longitudinal direction of the stacked header 51_3 extends parallel to the gravity direction. In the stacked header 51_3, the upper end part 51_3A is formed at the upper end of the stacked header 51_3 in the gravity direction, whereas the lower end part 51_3B is formed at the lower end of the stacked header 51_3 in the gravity direction.

The configurations other than the upper end and the lower end of each of the plates, the partial flow paths formed in the plates, and the distributing and combining flow paths formed as a result of stacking the plates together are the same as those in the stacked header 51_1 according to Embodiment 1.

Further, the flows of the refrigerant in the stacked header 51_3 are also the same as those in the stacked header 51_1 according to Embodiment 1.

As illustrated in FIG. 18, as a result of stacking the plates together, the stacked header 513 is assembled.

Incidentally, while the heat exchanger 1_3 is being used as an evaporator, the temperature of the refrigerant flowing through the heat exchanging part 2 is lower than the temperature of the outdoor air. As a result, the surface temperature of the stacked header 51_3 becomes lower than the dew point temperature of the air, Consequently, as illustrated in FIG. 19, water drops (condensed water W) adhere to the surface of the stacked header 51_3.

As illustrated in FIG. 19(*a*), in the conventional stacked header 510, the upper end part 510A and the lower end part 510E are each a horizontal face part. For this reason, the condensed water W adhering to the upper end part 510A and the lower end part 510E of the stacked header 510 stagnates as explained in Embodiments 1 and 2 and does not easily flow downward. Because the condensed water W stagnates, the stacked header 510 may be corroded. Also, after a defrosting operation, when drain water accumulates at the upper end part 510A and refreezes, the drain water extends upward in the gravity direction and pushes up the stacked header 510 positioned above. The stacked header 510 being pushed up may be deformed.

In contrast, as illustrated in FIG. 17, FIG. 18, FIG. 19(*b*), and FIG. 20 to FIG. 23, in the stacked header 51_3, both the upper end part 51_3A and the lower end part 51_3B are each a non-horizontal face part. For this reason, even when the condensed water W adheres to the upper end part 51_3A and the lower end part 51_3B of the stacked header 51_3, the condensed water W flows downward along the surface at both of the end parts. In particular, because the upper end part 51_3A and the lower end part 51_3B are each formed to have an arc shape, the condensed water W adhering to the upper end part 51_3A and the lower end part 51_3B flows downward along the arc. In this manner, the condensed water W can smoothly descend to be discharged, without stagnating.

Consequently, by using the stacked header 51 it is possible to prevent the condensed water W from stagnating at the upper end part 51_3A and the lower end part 51_3B. It is therefore possible to prevent the stacked header 51_3 from being corroded. Consequently, it is possible to provide the heat exchanger 1_3 having high reliability.

Further, even when the condensed water W freezes, neither of the stacked headers 51_3 positioned above and below will be deformed. This configuration therefore contributes to enhancement of reliability.

As illustrated in FIG. 17, by making the upper end and the lower end of each of the plates have an arc shape, the upper end part 51_3A and the lower end part 51_3B each having a semi-circular columnar shape are formed as illustrated in FIG. 16. In other words, the upper end part 51_3A and the lower end part 51_3B are each formed to have a curved face descending from a centerline of a corresponding one of the upper end part 51_3A and the lower end part 51_3B extending parallel to the flowing direction of the refrigerant, windward and leeward in the passage direction (indicated with the outlined arrow in the drawing) of the air passing through the heat exchanging part 2.

It should be noted, however, that it is only required that the upper end part 51_3A and the lower end part 51_3B are each a non-horizontal face part. The apex of the arc-shaped part at the upper end of each of the plates does not necessarily have to be positioned on the centerline of a corresponding one of the upper end part 51_3A and the lower end part 51_3B extending parallel to the flowing direction of the refrigerant.

For example, it is acceptable to adopt any of the shapes illustrated in FIG. 4 to FIG. 8 explained in Embodiment 1 as the shape of each of the upper end part 51_3A and the lower end part 51_3B of the stacked header 51_3.

Furthermore, the shape of the upper end part 51_3A and the shape of the lower end part 51_3B may be the same as each other or may be different from each other.

Further, the heat exchanger 1_3 according to Embodiment 3 may be installed as the outdoor heat exchanger 94 into the air-conditioning apparatus 91 according to Embodiment 1.

Further, while the outdoor heat exchanger 94 is being used as an evaporator, the temperature of the refrigerant may become lower than the temperature of the outdoor air. As a result, the surface temperature of the stacked header 51_3 becomes lower than the dew point temperature of the air, and water drops (condensed water) adhere to the surface of the stacked header 51_3, Because the upper end part 51_3A and the lower end part 51_2B of the stacked header 51_3 are each the non-horizontal face part, the condensed water generated at the upper end part 51_3A and the lower end part 51_3B of the stacked header 51_3 flows downward along the surfaces of the upper end part 51_3A and the lower end part 51_3B of the stacked header 51_3. Consequently, the condensed water smoothly descends without stagnating at the upper end part 51_3A and the lower end part 51_3B of the stacked header 51_3.

Further, when the temperature of the outdoor air decreases to lower than 0 degrees C., the condensed water may become frost and accumulate in the stacked header 51_3. At the same time, frost may accumulate on the fins (the windward fins 23, the leeward fins 33). To solve this problem, the air-conditioning apparatus 91 is configured to melt the accumulating frost by performing a defrosting operation either regularly or when a certain starting condition is satisfied. Further, after performing the defrosting operation, the air-conditioning apparatus 91 is configured to perform a heating operation again, but any of the condensed water failed to be discharged freezes again. In the conventional stacked header 510, because drain water stagnates at the upper end part 510A, a large amount of water refreezes. When the defrosting operation is repeatedly performed, the frost is not melted completely, but remains as ice, and such frost and ice grow upward. Because the stacked header 510 positioned above is pushed up by the growing ice, a joint or the heat transfer tubes connecting the heat exchanger to the stacked header 510 may be deformed.

In contrast, in the stacked header 51_3, the drain water melted by the defrosting operation is discharged without stagnating at the upper end part 51_3A. Consequently, it is possible to reduce the amount of water that refreezes during a heating operation performed after the defrosting operation. Even when some amount of water refreezes, because the amount of water that refreezes is small, the stacked header 510 positioned above is not pushed up. Consequently, it is possible to avoid the case where the heat exchanger 1_3 is damaged by the refrozen water.

Consequently, it is possible to prevent the condensed water from stagnating at the upper end part 51_3A and the lower end part 51_3B of the stacked header 51_3. It is therefore possible to prevent the stacked header 51_3 from being corroded by a long-term stagnation of the condensed water. Consequently, it is possible to provide the heat exchanger 1_3 having high reliability.

Further, in the stacked header 51_3, it is possible to significantly prevent the condensed water from stagnating at the upper end part 51_3A and the lower end part 51_3B, and it is thus possible to reduce the amount of water that refreezes. Consequently, the stacked header 51_3 positioned above is not pushed up. This configuration therefore contributes to enhancement of reliability of the heat exchanger 1_3.

In Embodiment 3, the stacked header 51_3 is explained as an example of the distributor; however, the structures of the upper end part 51_3A and the lower end part 51_3B described in Embodiment 3 are also applicable to flow paths of distributors and distributing devices using pipes having a more commonly-used configuration.

REFERENCE SIGNS LIST

1_1 heat exchanger 1_2 heat exchanger 1_3 heat exchanger 2 heat exchanging part 3 distributing and combining part 21 windward heat exchanging part 22 windward heat transfer tube 22*a* folded part 22*b* end

22*c* end 23 windward fin 31 leeward heat exchanging part 32 leeward heat transfer tube 32*a* folded part 32*b* end 32*c* end 33 leeward fin 41 windward joint part 42 leeward joint part 43 liaison pipe

51_1 stacked header 51_1A upper end part 51_1B lower end part

51_1C flow path forming part 51_2 stacked header 51_2A upper end part 51_2B lower end part 51_20 flow path forming part 51_3 stacked header

51_3A upper end part 51_3B lower end part 51_30 flow path forming part 51*a* distributing and combining flow path 51*a*_1 first distributing and combining flow path 51*a*_2 second distributing and combining flow path 51*a*_3 third distributing and combining flow path 51*a*_4 fourth distributing and combining flow path 52 connection pipe 53_1 first plate 53_1*a* partial flow path 53_2 first plate 53_2*a* partial flow path 53_2*b* partial flow path 53_3 first plate

53_3*a* partial flow path 53_4 first plate 53_4*a* partial flow path 53_4*b* partial flow path 53_5 first plate 53_5*a* partial flow path 53_5*b* partial flow path 53_6 first plate 53_6*a* partial flow path 54_1 second plate 54_1*a* partial flow path 54_2 second plate 54_2*a* partial flow path 54_3 second plate 54_3*a* partial flow path 54_4 second plate 54_4*a* partial flow path 54_5 second plate

54_5*a* partial flow path 57 connection pipe 6*l* cylindrical header 61*a* distributing and combining flow path 62 connection pipe 63 circular cylinder part 64 connection pipe 91 air-conditioning apparatus 92 compressor 93 four-way valve 94 outdoor heat exchanger 95 expansion device 96 indoor heat exchanger 97 outdoor fan 98 indoor fan 99 controller 510 stacked header

510A upper end part 510E lower end part W condensed water

The invention claimed is:

1. A stacked header comprising a plurality of plates stacked together and branching one flow path into a plurality of flow paths, wherein the stacked header includes:

an upper end part positioned at an upper end of the stacked header;

a lower end part positioned at a lower end of the stacked header; and a flow path forming part positioned between the upper end part and the lower end part and having a flow path formed in the flow path forming part, wherein adjacent ones of the plurality of plates have different lengths so that at least one of the upper end part or the lower end part comprises a non-horizontal face part having a non-horizontal face slanted with respect to a horizontal plane, and the at least one of the upper end part or the lower end part of the plurality of plates stacked together is the non-horizontal face part as a whole.

2. The stacked header of claim 1, wherein the non-horizontal face part is shaped to descend in two directions orthogonal to the flow path formed in the flow path forming part, the flow path serving as a boundary between the two directions.

3. The stacked header of claim 1, wherein the non-horizontal face part is shaped to descend in directions of the flow path formed in the flow path forming part, a middle part of the flow path serving as a boundary between the directions.

4. The stacked header of claim 1, wherein the non-horizontal face part has an arc-shaped cross-section.

5. The stacked header of claim 1, wherein the non-horizontal face part has a triangular cross-section.

6. The stacked header of claim 1, wherein the non-horizontal face part has a shape slanted in one direction with different heights of lateral faces of the flow path forming part.

7. The stacked header of claim 1, wherein the stacked header is a first stacked header and the heat exchanger includes a second stacked header that is like the first stacked header, and the stacked headers are arranged such that the first stacked header is above the second stacked header, and at least one of the lower end part of the first stacked header or the upper end part of the second stacked header comprises the non-horizontal face part.

8. The stacked header of claim 1, wherein at least one of an upper end or lower end of each of the plurality of plates has a curved face or slanted face.

9. A heat exchanger comprising:

the stacked header of claim 1, and a plurality of heat transfer tubes connected to the stacked header.

10. An air-conditioning apparatus, comprising the heat exchanger of claim 9.

11. A heat exchanger comprising the stacked header according to claim 1, wherein the heat exchanger is used as an evaporator, when a temperature of refrigerant flowing in the evaporator causes a surface temperature of the upper end part or the lower end part to be lower than a dew-point temperature of air surrounding the evaporator, water droplets form on the upper end part or the lower end part, and the non-horizontal face part having a non-horizontal face slanted with respect to a horizontal plane causes the water droplets to flow away from the upper end part or the lower end part to reduce corrosion of the stacked header.

* * * * *